US011829087B2

(12) United States Patent
Tanaka et al.

(10) Patent No.: US 11,829,087 B2
(45) Date of Patent: Nov. 28, 2023

(54) IMAGE FORMING APPARATUS WITH IMAGE BEARING MEMBERS HAVING DIFFERENT SURFACE LAYER THICKNESSES

(71) Applicant: CANON KABUSHIKI KAISHA, Tokyo (JP)

(72) Inventors: Hiroki Tanaka, Kanagawa (JP); Satoru Motohashi, Chiba (JP); Nobuo Oshima, Tokyo (JP); Akihisa Matsukawa, Tokyo (JP); Katsuichi Abe, Kanagawa (JP); Takayuki Namiki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/989,834

(22) Filed: Nov. 18, 2022

(65) Prior Publication Data

US 2023/0078948 A1 Mar. 16, 2023

Related U.S. Application Data

(62) Division of application No. 17/526,171, filed on Nov. 15, 2021, now Pat. No. 11,526,103.

(30) Foreign Application Priority Data

Dec. 25, 2020 (JP) ..... 2020-218059

(51) Int. Cl.
*G03G 15/16* (2006.01)
*G03G 21/10* (2006.01)
(Continued)

(52) U.S. Cl.
CPC ..... *G03G 15/1665* (2013.01); *G03G 15/0178* (2013.01); *G03G 15/0194* (2013.01);
(Continued)

(58) Field of Classification Search
CPC ..... G03G 15/0178; G03G 15/0194; G03G 15/0266; G03G 15/1645; G03G 15/1665;
(Continued)

(56) References Cited

U.S. PATENT DOCUMENTS 8,634,746 B2 1/2014 Kamimura et al.
8,934,797 B2 1/2015 Miyahara et al.
(Continued)

FOREIGN PATENT DOCUMENTS

JP 2001-183889 A 7/2001
JP 2010-165000 A 7/2010
(Continued)

*Primary Examiner* — Joseph S Wong
(74) *Attorney, Agent, or Firm* — Venable LLP

(57) ABSTRACT

An image forming apparatus includes a first image forming portion, a second image forming portion, a belt, a charging voltage applying portion, and a transfer voltage applying portion. With respect to a movement direction of a recording material, the first image forming portion is provided upstream of the second image forming portion. In an image forming operation, a potential difference between a first transfer voltage and a potential at a first transfer portion, which is formed on a first image bearing member and does not form the image, is greater than a potential difference between a second transfer voltage and a potential at a second transfer portion, which is formed on a second image bearing member and does not form an image.

10 Claims, 7 Drawing Sheets

(51) Int. Cl.
*G03G 15/01* (2006.01)
*G03G 15/02* (2006.01)

(52) U.S. Cl.
CPC ..... *G03G 15/0266* (2013.01); *G03G 15/1645* (2013.01); *G03G 15/1675* (2013.01); *G03G 15/1685* (2013.01); *G03G 21/10* (2013.01)

(58) Field of Classification Search
CPC . G03G 15/1675; G03G 15/1685; G03G 21/10
See application file for complete search history.

(56) References Cited

U.S. PATENT DOCUMENTS

| | | | | |
|---|---|---|---|---|
| 9,483,013 | B2 | 11/2016 | Adachi | |
| 10,606,184 | B2 * | 3/2020 | Ikeda | G03G 15/104 |
| 2013/0308969 | A1 * | 11/2013 | Hasegawa | G03G 15/5033 399/50 |
| 2020/0310302 | A1 * | 10/2020 | Suzuki | G03G 5/14726 |

FOREIGN PATENT DOCUMENTS

| | | | |
|---|---|---|---|
| JP | 2012-008402 | A | 1/2012 |
| JP | 2013-250471 | 4 | 12/2013 |

* cited by examiner (a)

(b)

IMAGE FORMING APPARATUS WITH IMAGE BEARING MEMBERS HAVING DIFFERENT SURFACE LAYER THICKNESSES

FIELD OF THE INVENTION AND RELATED ART

The present invention relates to an image forming apparatus, such as a printer, a copying machine, or a facsimile machine, using an electrophotographic type.

Conventionally, as the image forming apparatus of the electrophotographic type, there is an image forming apparatus having a constitution in which an image is formed on a recording material by transferring toner images, formed on a plurality of image bearing members, onto the recording material fed while being carried on a recording material carrying member. In this image forming apparatus, corresponding to each of the image bearing members, a charging member for electrically charging the image bearing member, a developing device for forming the toner image by supplying toner as a developer to the image bearing member, and a transfer member for transferring the toner image from the image bearing member onto the recording material are provided. As the recording material carrying member, a transfer voltage constituted by an endless belt is used in many instances. Further, onto the recording material electrostatically attracted to this transfer belt and fed by this transfer belt, the toner images are successively transferred from the plurality of image bearing members disposed and arranged along a movement direction of the recording material by the recording material carrying member. As the transfer member, a transfer roller or the like provided on a side opposite from the image bearing member while sandwiching the transfer belt therebetween is used, and the transfer of the toner image is carried out by applying a transfer voltage to the transfer member.

Further, in the image forming apparatus as described above, a cleaning means for removing toner (transfer residual toner), from the image bearing member, remaining on the image bearing member without being transferred onto the recording material is provided.

As this cleaning means, the following cleaning means has been known. A cleaning roller is provided as a cleaning member contacting the image bearing member, and during image formation, the transfer residual toner is deposited on the cleaning roller and is temporarily collected. By this, occurrence of an image defect due to the influence of the transfer residual toner on a subsequent image forming process is suppressed. Further, the transfer residual toner temporarily collected by the cleaning roller is discharged from the cleaning roller onto the image bearing member at a predetermined timing during non-image formation. Then, the transfer residual toner discharged on the image bearing member is collected in a developing device. The transfer residual toner collected in the developing device is re-used for developing an electrostatic latent image into a toner image.

Further, when the recording material and the image bearing member contact each other, a foreign matter is deposited on the surface of the image bearing member. This foreign matter is principally fibers and a filler which form paper (so-called "paper powder") or dust deposited on the recording material, or the like. When such a foreign matter is deposited on the surface of the image bearing member, the foreign matter has the influence on a subsequent image forming process, so that the image defect occurs in some instances.

In Japanese Laid-Open Patent Application 2010-165000, a constitution in which only a most upstream image bearing member, with respect to a recording material movement direction, which is most affected by the foreign matter is provided with a foreign matter collecting member for attracting and collecting the foreign matter from the above-described cleaning roller is disclosed. In this constitution, the foreign matter moved to the most upstream image bearing member during the image formation is collected on the cleaning roller during the non-image formation and then is collected on the foreign matter collecting member, so that the foreign matter is accommodated in an accommodating portion.

As in the above-described conventional constitution, most of the foreign matter can be collected by providing the foreign matter collecting member to the most upstream image bearing member with respect to the recording material movement direction. This is because most of the foreign matter generating from the recording material is removed by being moved onto the most upstream image bearing member to which the recording material is first contacted. However, the foreign matter in a slight amount is not moved to the most upstream image bearing member but is deposited on the image bearing member on a side downstream of the most upstream image bearing member with respect to the recording material movement direction in some instances.

Heretofore, even when the foreign matter in the slight amount moved to the downstream-side image bearing member is carried on the image bearing member or on the cleaning roller, for example, and is collected together with the transfer residual toner in the developing device, a problem does not become obvious. However, in recent years, there is a tendency that the image bearing members and units including the developing devices, which are consumables, or the image forming apparatus are extended in lifetime. That is, there is a tendency that a total amount of the foreign matter moved to the downstream-side image bearing member increases. For that reason, there arose a possibility that the image defect occurs by the influence of the foreign matter moved to the downstream-side image bearing member without being completely moved to the most upstream image bearing member, even by the slight amount. This problem is conspicuous in a constitution in which the foreign matter collecting member is provided to only the most upstream image bearing member as described above, but this is true for the case where the foreign matter collecting member is also provided to the downstream-side image bearing member. As a result, the foreign matter is fixed to the image bearing member by being carried on the image bearing member for a long term, so that a stripe-like image defect, a dot-like image defect, or the like occurs on an image in some instances. Further, the foreign matter is carried on the cleaning roller for a long term, whereby the foreign matter is fixed to the image bearing member, so that a cleaning performance for the transfer residual toner lowers, and thus an image defect due to improper cleaning occurs in some instances. Further, for example, when an amount of the foreign matter collected together with the transfer residual toner in the developing device gradually increases and exceeds a certain threshold, an electric charge of the toner is disordered and causes the image defect in some instances.

In order to solve the above-described problem, it is important that power of removing the foreign matter from the recording material at the upstream-side image forming portion is enhanced and thus an amount of the foreign matter sent to the downstream-side image forming portion is decreased.

SUMMARY OF THE INVENTION

Accordingly, a principal object of the present invention is to suppress the image defect due to the foreign matter generated with extension of the lifetime of the image bearing member or the unit including the developing device by reducing the amount of the foreign matter moved to the downstream-side image bearing member through enhancement of the power of moving the foreign matter to the upstream-side image bearing member.

According to an aspect of the present invention, there is provided an image forming apparatus capable of executing an image forming operation for forming an image on a recording material, the image forming apparatus comprising: a first image forming portion including a rotatable first image bearing member, a first charging member for electrically charging a surface of the first image bearing member, a first developing member for supplying a first developer to the surface of the first image bearing member, a first transfer member for transferring the first developer, supplied to the surface of the first image bearing member, onto a recording material, a first cleaning member for cleaning the surface of the first image bearing member in contact with the first image bearing member, and a foreign matter collecting member for collecting a foreign matter deposited on the first cleaning member in contact with the first cleaning member; a second image forming portion including a rotatable second image bearing member, a second charging member for electrically charging a surface of the second image bearing member, a second developing member for supplying a second developer to the surface of the second image bearing member, a second transfer member for transferring the second developer, supplied to the surface of the second image bearing member, onto a recording material, and a second cleaning member for cleaning the surface of the second image bearing member in contact with the second image bearing member; a belt configured to form a first transfer portion in contact with the first image bearing member and to form a second transfer portion in contact with the second image bearing member, the belt nipping and feeding the recording material between itself and the first image bearing member at the first transfer portion and between itself and the second image bearing member at the second transfer portion; a charging voltage applying portion configured to apply a first charging voltage to the first charging member and to apply a second charging voltage to the second charging member: and a transfer voltage applying portion configured to apply a first transfer voltage to the first transfer member and to apply a second transfer voltage to the second transfer member, wherein with respect to a movement direction of the recording material, the first image forming portion is provided upstream of the second image forming portion, and wherein in the image forming operation, a potential difference between the first transfer voltage and a potential, at the first transfer portion, which is formed on the first image bearing member and does not form the image is larger than a potential difference between the second transfer voltage and a potential, at the second transfer portion, which is formed on the second image bearing member and does not form the image.

Further features of the present invention will become apparent from the following description of exemplary embodiments with reference to the attached drawings.

Figure 2:
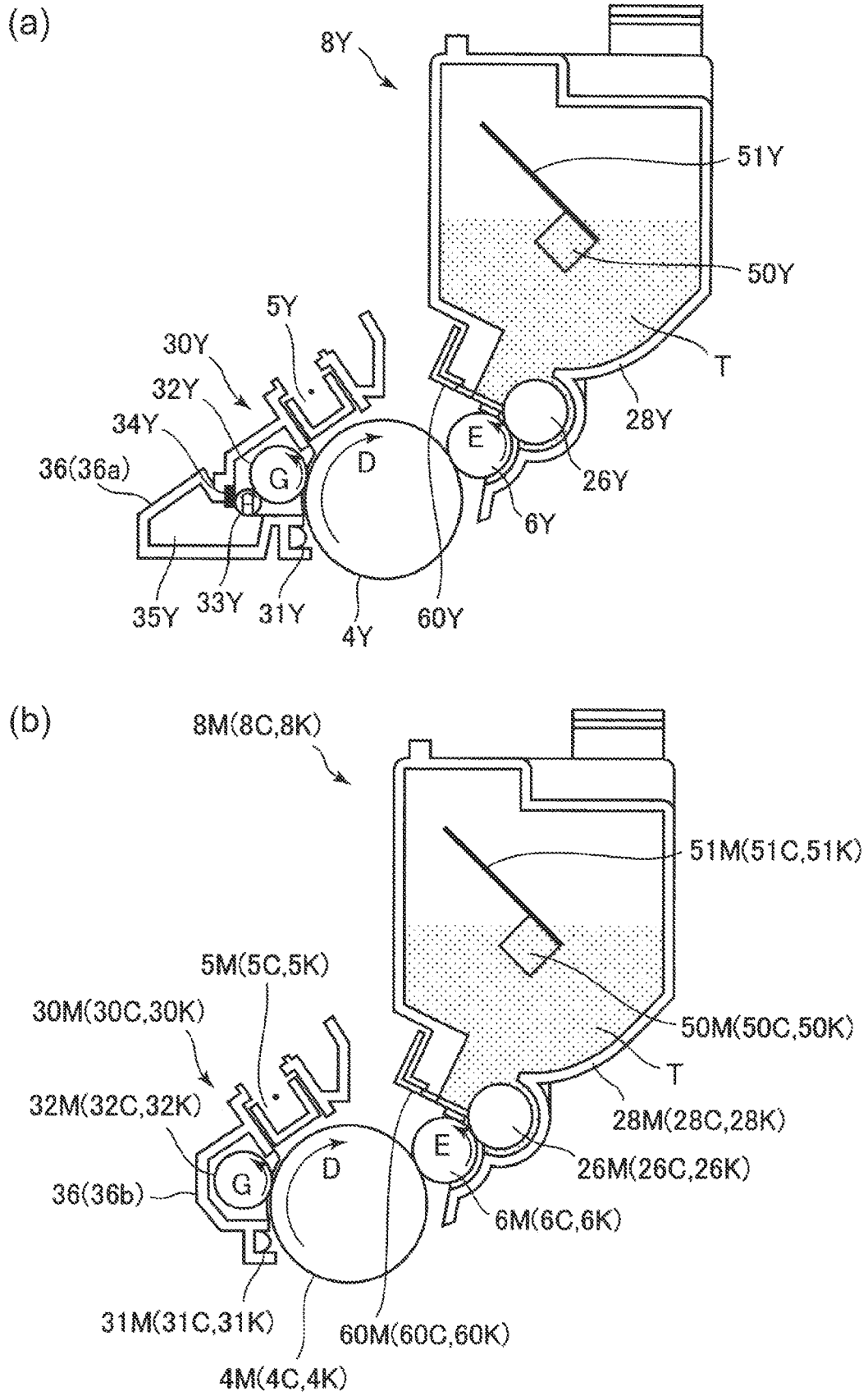

Parts (a) and (b) of FIG. 2 are schematic sectional views each showing a drum unit and a developing cartridge.

Figure 3:
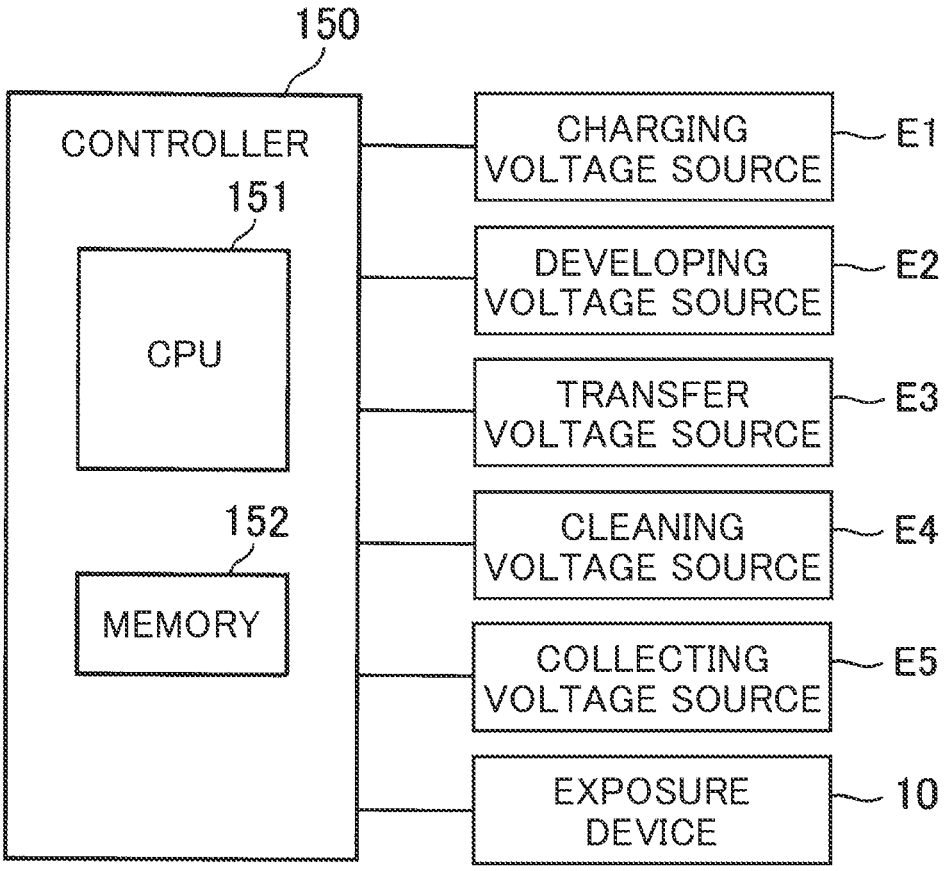

FIG. 3 is a schematic block diagram for illustrating a control mode of the image forming apparatus.

Figure 4:
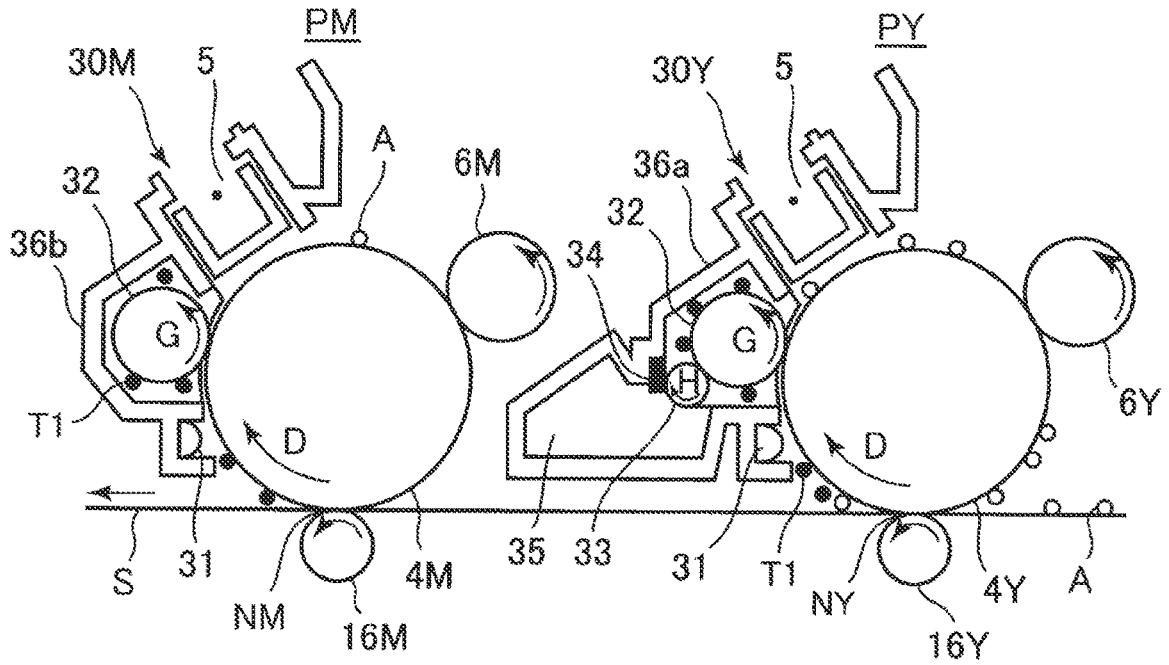
Figure 4:
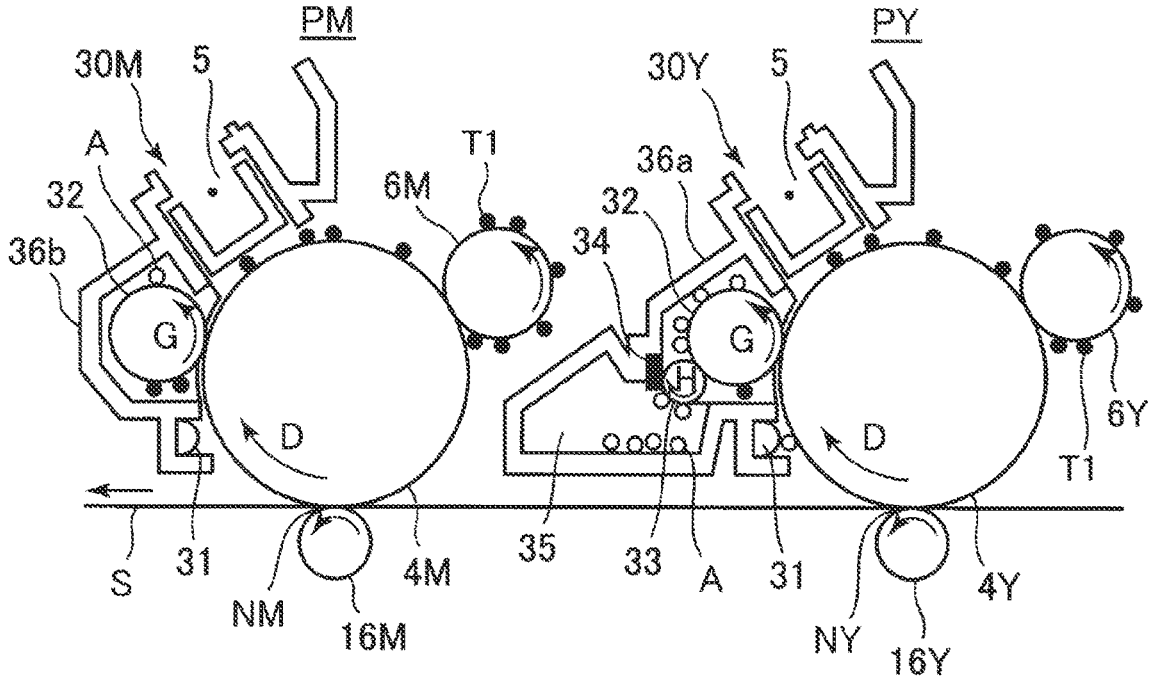

Parts (a) and (b) of FIG. 4 are schematic views for illustrating collection of transfer residual toner and a foreign matter.

Figure 5:
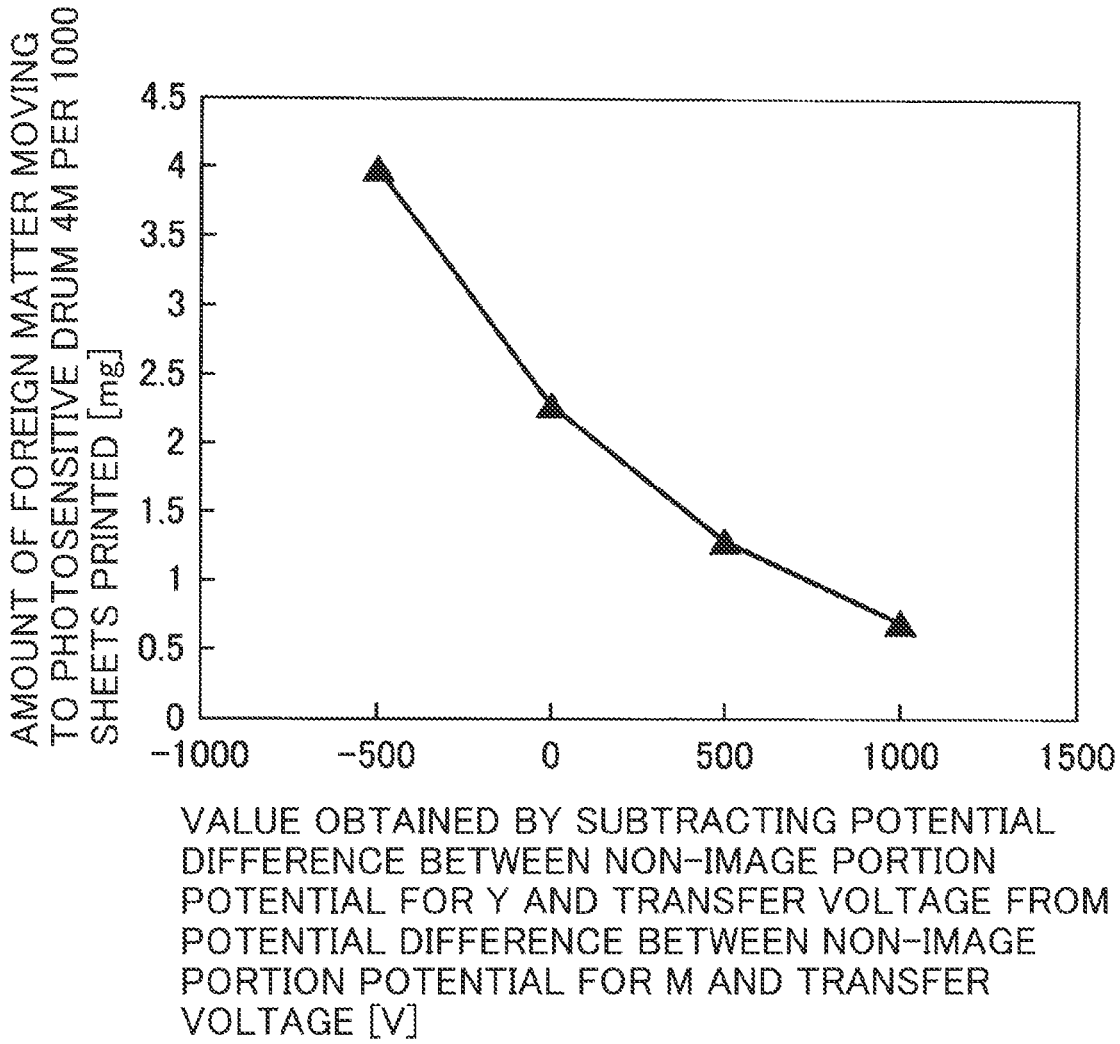

FIG. 5 is a graph showing a relationship between a potential difference, between a non-image portion potential and a transfer voltage, and an amount of the foreign matter moved to a downstream-side photosensitive drum.

Figure 6:
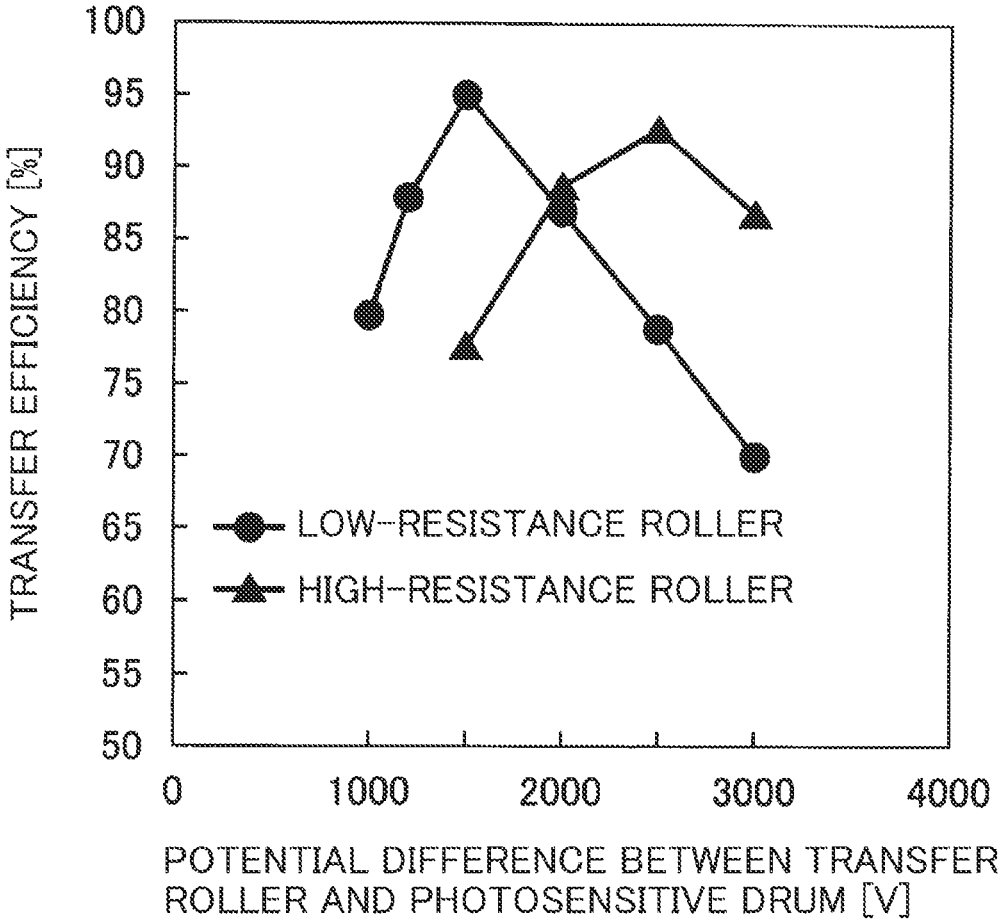

FIG. 6 is a graph for illustrating a relationship between an electric resistance of a transfer roller and a transfer efficiency.

Figure 7:
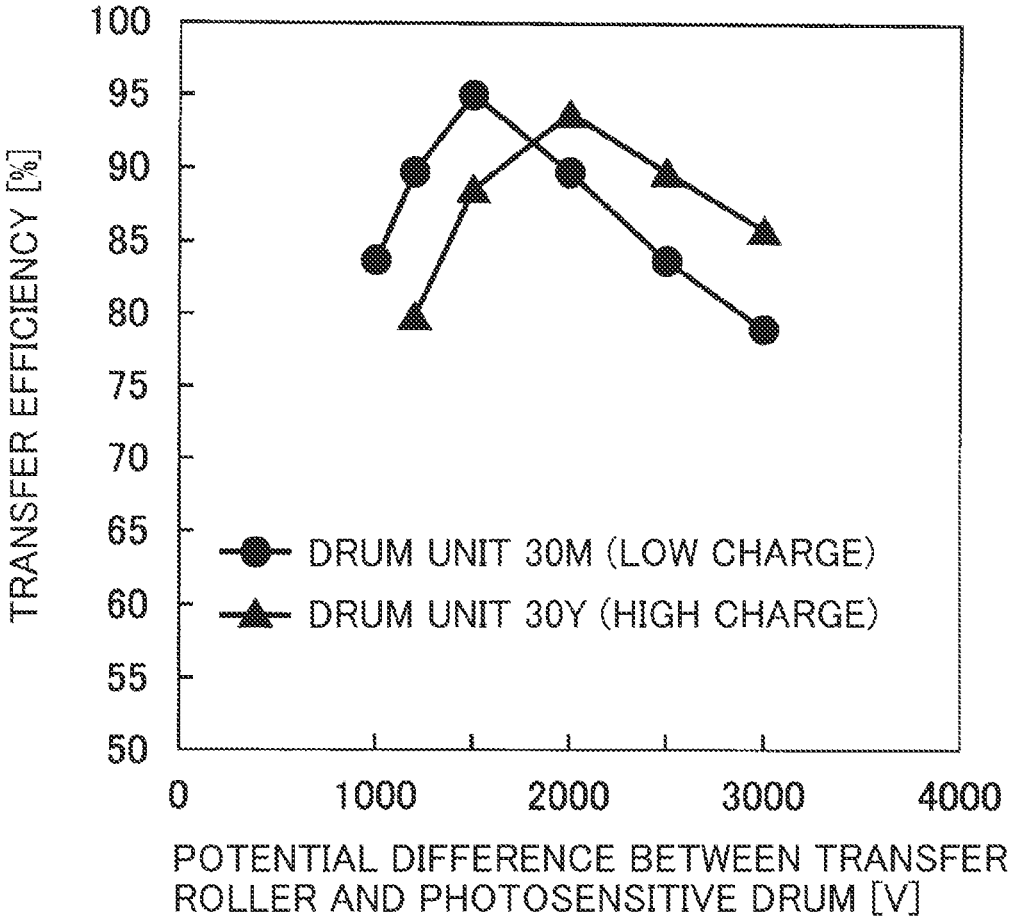

FIG. 7 is a graph for illustrating a relationship between an electric charge amount of toner and the transfer efficiency.

DESCRIPTION OF THE EMBODIMENTS

In the following, an image forming apparatus according to the present invention will be specifically described with reference to the drawings.

Embodiment 1

<Constitution of Image Forming Apparatus>

Figure 1:
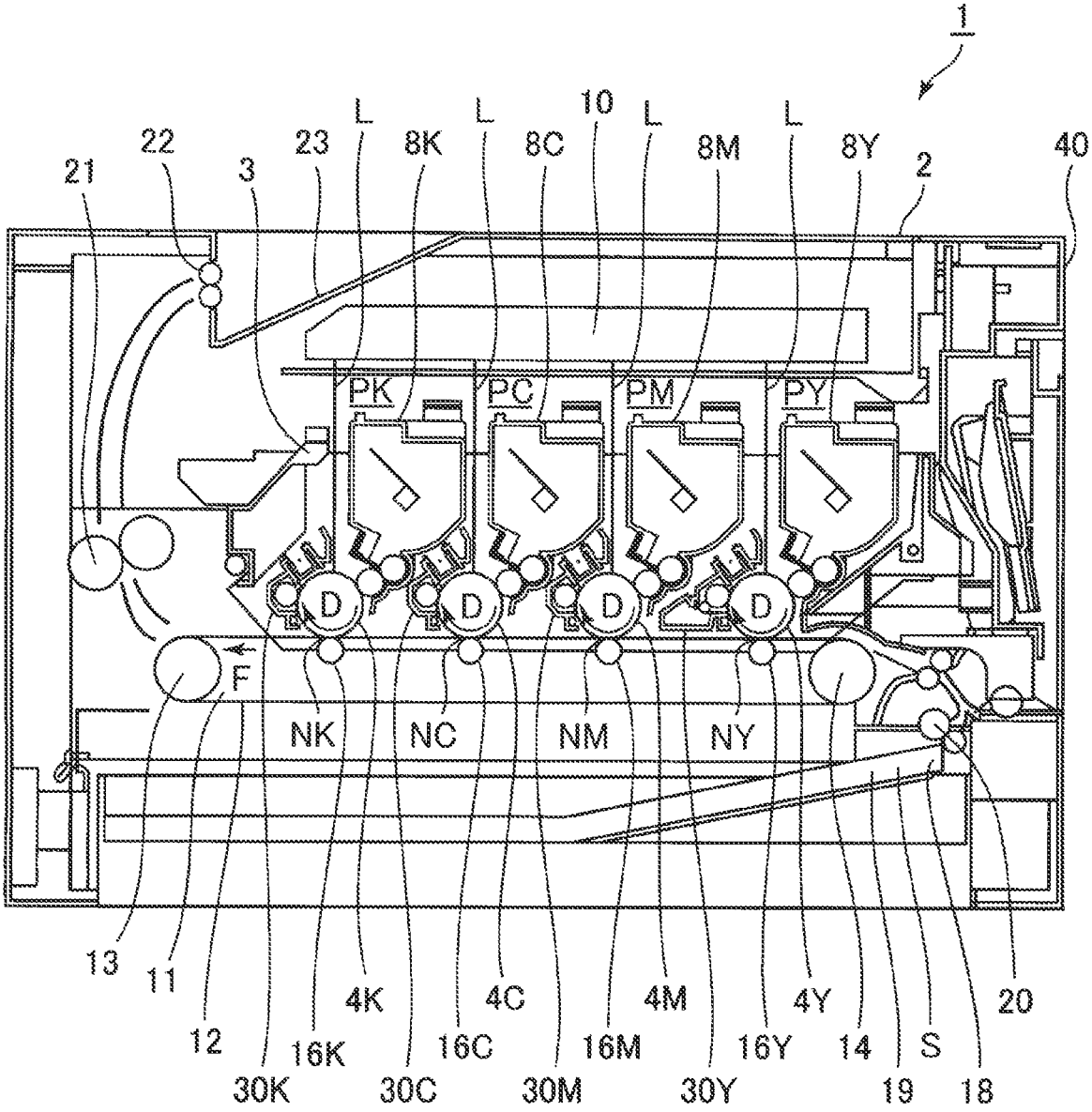
FIG. 1 is a schematic sectional view of an image forming apparatus.

FIG. 1 is a schematic sectional view of an image forming apparatus 1 of an embodiment 1. The image forming apparatus 1 of the embodiment 1 is a color laser printer using an electrophotographic image forming process and is capable of forming a color image on a recording material S in accordance with image information from an external device from a personal computer or the like.

The image forming apparatus 1 includes four image forming portions (stations) PY, PM, PC and PK for forming images of colors of yellow (Y), magenta (M), cyan (C) and the black (K), respectively. As regards elements having the same or corresponding functions or constitutions in the four image forming portions PY, PM, PC and PK, description will be made collectively in some instances by omitting suffixes Y, M, C and K of reference numerals or symbols representing elements for associated colors, respectively.

In the embodiment 1, each of the image forming portions P includes a photosensitive drum 4 which is a drum-type (cylindrical) photosensitive member (electrophotographic photosensitive member) as a rotatable image bearing member, a charging device (charging member) 5 (FIG. 2) as a charging means, and a developing device 8 as a developing means. Further, each image forming portion P includes a transfer roller 16 which is a roller-type transfer member as a transfer means, a discharging light source 31 (FIG. 2) as a discharging means, and a cleaning mechanism 36 (FIG. 2) as a cleaning means. The four image forming portions PY, PM, PC and PK are arranged and disposed in line along a movement direction of the recording material S by a transfer belt 12 (described later) (herein, also simply referred to as a "movement direction of the recording material S"). Further, in the embodiment 1, an exposure device 10 used as an exposure means in each image forming portion P is constituted as a single unit. Further, in the embodiment 1, in each image forming portion P, each of a drum unit 30 including the photosensitive drum 4 and the developing device (developing cartridge, developing unit) 8 is an exchangeable unit as a consumable.

Parts (a) and (b) of FIG. 2 are schematic sectional views each showing the drum unit 30 and the developing cartridge 8. Part (a) of FIG. 2 shows a drum unit 30Y and a developing cartridge 8Y of a most upstream image forming portion PY with respect to the movement direction of the recording material S. Part (b) of FIG. 2 shows drum units 30M, 30C and 30K and developing cartridges 8M, 8C and 8K of the image forming portions PM, PC and PK on sides downstream of the most upstream image forming portion PY with respect to the movement direction of the recording material S (herein, also simply referred to as a "downstream side"). Incidentally, as regards the plurality of image forming portions P and the elements thereof, "upstream" and "downstream" refer to "upstream" and "downstream" with respect to the movement direction of the recording material S. As shown in parts (a) and (b) of FIG. 2, in the embodiment 1, a constitution of h cleaning mechanism 36 is different between the most upstream drum unit 30Y and the downstream-side drum units 30M, 30C and 30K. The constitutions and operations of the drum unit 30 and the developing cartridge 8 will be specifically described later.

A cartridge tray 3 is provided so as to be mountable in and dismountable from an apparatus main assembly 2 of the image forming apparatus 1. Further, each of the drum unit 30 and the developing cartridge 8 is constituted so as to be mountable in and dismountable from this cartridge tray 3. Further, in the apparatus main assembly 2, the exposure device 10, an electrostatic transfer device 11, a sheet feeding unit 18, a fixing device 21, a discharging unit 22, and a front door 40 are provided.

The exposure device 10 is provided above the drum unit 30 and the developing cartridge 8 which are mounted in the cartridge tray 3, and outputs laser light L corresponding to image information. The exposure device 10 exposes surfaces of the four photosensitive drums 4Y, 4M, 4C and 4K to this laser light L.

The electrostatic transfer device 11 is provided below the drum unit 30 and the developing cartridge 8 which are mounted in the cartridge tray 3. The electrostatic transfer device 11 includes the transfer belt 12 constituted by an endless belt as a recording material carrying member so as to contact the four photosensitive drums 4Y, 4M, 4C and 4K. As the transfer belt 12, a film-like member such as a resin film or a multi-layer film in which a resin layer is formed on a rubber base layer is used. The transfer belt 12 is stretched at a predetermined tension by being extended around a driving roller 13 and a follower roller 14, which are used as a plurality of stretching rollers (supporting rollers). Further, the transfer belt 12 electrostatically attracts a sheet-like recording material (recording medium, transfer material, sheet) S such as paper to an upper-side outer peripheral surface thereof in FIG. 1, and is circulated and moved so that the recording material S is successively contacted to the four photosensitive drums 4Y, 4M, 4C and 4K. On an inner peripheral surface side of the transfer belt 12, four transfer rollers 16Y, 16M, 16C and 16K are provided correspondingly to the four photosensitive drums 4Y, 4M, 4C and 4K, respectively. In the embodiment 1, the transfer rollers 16 are disposed opposed to the corresponding photosensitive drums 4 via the transfer belt 12, and are contacted to the photosensitive drums 4 via the transfer belt 12. By this, transfer portions NY, NM, NC and NK where the photosensitive drums 4Y, 4M, 4C and 4K and the transfer belt 12 are in contact with each other are formed. Thus, the transfer belt 12 forms the transfer portions N in contact with the photosensitive drums 4, so that the recording material S is nipped and fed between the transfer belt 12 and the photosensitive drums 4 in the transfer portions N. During transfer, to the transfer rollers 16, a predetermined transfer voltage (transfer bias) is applied, so that an electric charge is applied to the recording material S via the transfer belt 12. By an electric field generated at this time, onto the recording material S during contact with the photosensitive drum 4, the toner image on the photosensitive drum 4 is transferred. In the embodiment 1, the transfer roller 16 is constituted by coating, around a roller shaft formed of metal or the like, a sponge layer formed of a sponge material (a foamed rubber material such as foamed polyurethane) as an elastic layer.

The sheet feeding unit 18 is provided below the electrostatic transfer device 11. The sheet feeding unit 18 includes a sheet feeding tray 19 as a recording material accommodating portion in which recording materials S are stacked and accommodated, and a sheet feeding roller 20 as a feeding member.

The fixing device 21 and the discharging unit 22 are provided above the electrostatic transfer device 11. The fixing device 21 fixes, on the recording material S, the toner image transferred on the recording material S.

Further, the discharging unit 22 discharges, onto a discharge tray 23, the recording material S passed through the fixing device 21.

As shown in parts (a) and (b) of FIG. 2, the drum unit 30 includes the charging device 5, the discharging light source 31, the cleaning mechanism 36, and the like. As shown in part (a) of FIG. 2, the most upstream drum unit 30Y includes a first cleaning mechanism 36*a* as the cleaning mechanism 36.

The first cleaning mechanism 36*a* includes cleaning roller 32 as a cleaning member for cleaning the surface of the photosensitive drum 4, and a foreign matter collecting roller 33 as a foreign matter collecting member for collecting a foreign matter deposited on the cleaning roller 32. Further, the first cleaning mechanism 36*a* includes a scraping member 34 as a foreign matter removing member, and a foreign matter collecting container 35 as an accommodating portion. Further, as shown in part (b) of FIG. 2, each of downstream-side drum units 30M, 30C and 30K includes a second cleaning mechanism 36*b* as the cleaning mechanism 36. The second cleaning mechanism 36*b* includes the cleaning roller 32 as the cleaning member. In the embodiment 1, the second cleaning mechanism 36*b* does not include the foreign matter collecting roller 33, the scraping member 34, and the foreign matter collecting container 35 which are provided in the first cleaning mechanism 36*a*. Incidentally, in the embodiment 1, in the first cleaning mechanism 36*a*, the cleaning roller 32 is connected to a cleaning voltage source E4 (FIG. 3), and the foreign matter collecting roller 33 is connected to a collecting voltage source E5 (FIG. 3). Further, in the second cleaning mechanism 36*b*, the cleaning roller 32 is connected to the cleaning voltage source E4 (FIG. 3).

As shown in parts (a) and (b) of FIG. 2, the developing cartridge 8 includes a developing frame (developing container) 28 for accommodating toner T as a developer, and a developing roller 6 as a rotatable developer carrying member for carrying the toner T on the surface thereof. Further, the developing cartridge 8 includes a supplying roller 26 as a developer supplying member for supplying the toner T to the developing roller 6, and a regulating blade 60 as a developer regulating member for regulating a layer thickness of the toner T carried on the surface of the developing roller 6. Further, the developing cartridge 8 includes, as a stirring/feeding member for stirring and feeding the toner T in the developing frame 28, a rotatable stirring shaft 50 and a stirring sheet 51 fixed to this stirring shaft 50. In the embodiment 1, the toner T is a non-magnetic, one-component developer.

<Image Forming Process>

Next, with reference to FIGS. 1 and 2, an image forming process in the image forming apparatus 1 of the embodiment 1 will be described.

During execution of the image forming process, the photosensitive drum 4 is rotationally driven by a driving motor (not shown) as a driving means in an arrow D direction (the clockwise direction) in FIGS. 1 and 2 at a predetermined process speed. Further, the transfer belt 12 of the electrostatic transfer device 11 is rotated (circulated and moved) in an arrow F direction (the counterclockwise direction) in FIG. 1 at a peripheral speed corresponding to the peripheral speed of the photosensitive drum 4 by rotationally driving the driving roller 13 by the driving motor (not shown) as the driving means. The surface of the rotating photosensitive drum 4 is electrically charged uniformly to a predetermined polarity (positive in the embodiment 1) and a predetermined potential by the charging device 5. During the charging, to the charging device 5, a predetermined charging voltage (charging bias) is applied by a charging voltage source E1 (FIG. 3) as a charging voltage applying portion. In the embodiment 1, the charging voltage source E1 applies a DC voltage of the positive polarity as the charging voltage. The charged surface of the photosensitive drum 4 is subjected to scanning exposure to the laser light L outputted depending on an image signal for an associated color, so that an electrostatic latent image (electrostatic image) depending on the image signal for the associated color is formed on the photosensitive drum 4. In the embodiment 1, an image portion (print portion, image region) on the photosensitive drum 4 on which a potential (non-image portion potential, dark portion potential) of a non-image portion (non-print portion, non-image region) is formed by a uniform charging process is irradiated with the laser light L. By this, an absolute value of the potential at a portion irradiated with the laser light L lowers, so that a potential (image portion potential, light portion potential) at the image portion is formed.

The electrostatic latent image formed on the photosensitive drum 4 is developed (visualized) by being supplied with the toner by the developing cartridge 8, so that a toner image (developer image) depending on the image signal for the associated color is formed on the photosensitive drum 4. The toner T in the developing frame 28 is fed toward the supplying roller 26 while being circulated in the developing frame 28 by the stirring sheet 51 fixed to the stirring shaft 50. The supplying roller 26 supplies the toner T toward the developing roller 6. The developing roller 6 is constituted by coating, around a roller shaft (axis) formed of metal or the like, a rubber layer formed of a rubber material as an elastic layer. As the rubber layer, a solid rubber member or a sponge member, each of which has elasticity, is used. In the embodiment 1, the developing roller 6 contacts the photosensitive drum 4. The supplying roller 26 is constituted by coating, around a roller shaft (axis) formed of metal or the like, a sponge layer formed of a sponge material (foamed rubber material such as foamed polyurethane) as the elastic layer. In the embodiment 1, the supplying roller 26 contacts the developing roller 6. The developing roller 6 is rotationally driven in an arrow E direction (counterclockwise direction) in FIG. 2 at a predetermined peripheral speed. That is, the developing roller 6 is rotated so that the photosensitive drum 4 and the developing roller 6 move in the same direction at a contact portion therebetween. In the embodiment 1, the developing roller 6 is rotationally driven by a driving force which is transmitted from the driving motor (not shown) for driving the photosensitive drum 4 and which is branched. The developing roller 6 may be rotationally driven with a peripheral speed difference (for example, the developing roller 6 is rotated faster than the photosensitive drum 4) relative to the photosensitive drum 4 or may also be rotationally driven at the same peripheral speed as the photosensitive drum 4. The toner T supplied to the developing roller 6 enters between the developing roller 6 and the regulating blade 60 and is carried as a thin layer with a certain thickness on the developing roller 6. The toner T is charged to a predetermined polarity (positive polarity in the embodiment 1) by triboelectric charge between the regulating blade 60 and the developing roller 6 or between the supplying roller 26 and the developing roller 6. That is, in the embodiment 1, a normal charge polarity ("normal polarity") of the toner T which is a charge polarity during development is the positive polarity. The regulating blade 60 is constituted by bonding a resin member to a metal plate formed of stainless steel or the like.

By a shape or a material of the resin member, a pressure applied to the toner T entered between the developing roller 6 and the regulating blade 60, and a triboelectric charge amount of the toner T are capable of being controlled. As the resin member, a silicone rubber or a urethane rubber is used.

The toner T carried on the developing roller 6 and charged to the positive polarity is supplied to the electrostatic latent image formed on the photosensitive drum 4. By this, the toner T is deposited on an image portion of the electrostatic latent image, so that the toner image is formed on the photosensitive drum 4. Further, to the developing roller 6, a predetermined developing voltage (developing bias) is applied by a developing voltage source E2 (FIG. 3) as a developing voltage applying portion. In the embodiment 1, the developing voltage source E2 applies, to the developing roller 6, a DC voltage of the positive polarity as the developing voltage. The developing voltage is set at a potential between an image portion potential and a non-image portion potential on the photosensitive drum 4. That is, the potential of the electrostatic latent image is larger in absolute value than the voltage applied to the developing roller 6 at the non-image portion where the toner T is not deposited (i.e., the image is not formed), and is smaller in absolute value than the voltage applied to the developing roller 6 at the image portion where the toner T is deposited (i.e., the image is formed). By this setting, the toner T charged to the positive polarity is moved from the developing roller 6 to the image portion of the electrostatic latent image formed on the photosensitive drum 4. Thus, in the embodiment 1, on an exposure portion (image portion) on the photosensitive drum 4 lowered in absolute value of the potential by being exposed to light after being uniformly charged, the toner T charged to the same polarity (the positive polarity in the embodiment 1) as the charge polarity of the photosensitive drum 1 (reverse development) is deposited.

Further, at a predetermined control timing, recording materials S are separated and fed one by one by the sheet feeding unit 18. This recording material S is fed to the transfer belt 12 at a predetermined control timing so that a timing when a leading end of the toner image on the most upstream photosensitive drum 4Y moves to the transfer portion NY and a timing when the recording material S is fed to the transfer portion NY are synchronized with each other (image formation start positions coincide with each other). Onto the recording material S electrostatically attracted to the transfer belt 12 and fed by the transfer belt 12, the toner images are successively transferred from the photosensitive drums 4 by electric fields formed between the photosensitive drums 4 and the associated transfer rollers 16. During the transfer, to each of the transfer rollers 16, a predetermined transfer voltage (transfer bias) is applied by a transfer voltage source E3 (FIG. 3) as a transfer voltage applying portion. In the embodiment 1, the transfer voltage source E3 applies, to the transfer roller 16, a DC voltage of the negative polarity which is an opposite polarity to the normal polarity (the positive polarity in the embodiment 1) of the toner T, as the transfer voltage. By this, the toner T charged to the positive polarity can be electrically attracted to the recording material S side.

The recording material S on which the toner images of the four colors are transferred is separated from the transfer belt 12 and is fed to the fixing device 21. The fixing device 21 heats and presses the recording material S on which the unfixed toner images are carried, so that the fixing device 21 fixes (melts, sticks) the toner images on the recording material S. Thereafter, the recording material S is discharged (outputted) by the discharging unit 22 toward the discharge tray 23 provided outside the apparatus main assembly 2.

On the other hand, after the toner T is transferred onto the recording material S, the surface of the photosensitive drum 4 is irradiated with discharging light by the discharging light source 31, so that the surface potential is discharged to about 0 V. By this, the surface potential of the photosensitive drum 4 is stabilized, so that a cleaning property, by the cleaning roller 32, for the toner (transfer residual toner) remaining on the photosensitive drum 4 without being transferred onto the recording material S and the foreign matter moved from the recording material S onto the photosensitive drum 4 is improved. Incidentally, the action of the cleaning roller 32 will be described later in detail. Further, the surface potential of the photosensitive drum 4 is stabilized, so that the surface of the photosensitive drum 4 can be charged uniformly by the charging device 5. Incidentally, the discharge includes that at least a part of the electric charge is removed (attenuated).

<Control Mode>

FIG. 3 is a schematic block diagram showing a control mode of a principal part of the image forming apparatus 1 of the embodiment 1. The image forming apparatus 1 is provided with a controller 150. The controller 150 includes a CPU 151 as a calculation control means which is a central element for performing a calculating process, a memory (storing element) 152 such as a ROM, a RAM, or the like as a storing means, an input/output portion (not shown) for controlling transfer of signals between itself and each of various elements connected to the controller 150. In the RAM, a detection result of a sensor, a calculation result, and the like are stored, and in the ROM, a control program, a data table acquired in advance, and the like are stored.

The controller 150 is a control means for carrying out integrated control of an operation of the image forming apparatus 1. The controller 150 controls transfer of various electrical information signals, a drive timing, and the like, and executes a predetermined image forming sequence. To the controller 150, respective portions of the image forming apparatus 1 are connected. For example, in relation to the embodiment 1, to the controller 150, the charging voltage source E1, the developing voltage source E2, the transfer voltage source E3, the cleaning voltage source E4, the collecting voltage source E5, the exposure device 10, and the like are connected. The controller 150 controls ON/OFF and output values of these various voltage sources E1, E2, E3, E4 and E5, an exposure amount by the exposure device 10, and the like, and thus controls an image forming operation and an operation of the cleaning mechanism 36 described later.

Incidentally, in the embodiment 1, the charging voltage source E1, the developing voltage source E2, the transfer voltage source E3, and the cleaning voltage source E4 are independently provided for each of the image forming portions P. However, at least one of the charging voltage source E1, the developing voltage source E2, the transfer voltage source E3, and the cleaning voltage source E4 may also be common to a plurality of the image forming portions (or all the image forming portions P). Further, in the embodiment 1, the collecting voltage source E5 is provided for only the image forming portion PY.

The image forming apparatus 1 is, in the embodiment 1, capable of executing a job (printing operation) which is a series of operations for forming an image on a single recording material S or images on a plurality of recording materials S by a single start instruction from an external device such as a personal computer. The job generally includes an image forming step (printing step), a pre-rotation step, a sheet interval in the case where the images are formed on the plurality of the recording materials S, and a post-rotation step. The image forming step is a period in which formation of the electrostatic (latent) image on the photosensitive drum 1, development of the electrostatic image (toner image formation), transfer of the toner image, fixing of the toner image, and the like are carried out, and during image formation refers to this period. Specifically, the timing during the image formation is different at positions where the formation of the electrostatic image, the formation of the toner image, the transfer of the toner image, the fixing of the toner image, and the like are carried out. The pre-rotation is a period in which a preparatory operation before the image forming step is performed. The sheet interval step is a period corresponding to an interval between a current recording material S and a subsequent recording material S when the image forming step for forming the images on the plurality of recording materials S is continuously performed during continuous image formation. The post-rotation step is a period of a post-operation (preparatory operation) after the image forming step. During the non-image formation refers to a period other than during the image formation and includes the pre-rotation step, the sheet interval, and the post-rotation step which are described above, and further includes a pre-multi-rotation step which is a preparatory operation during turning-on of a power source of the image forming apparatus 1 or during restoration from a sleep state. In the embodiment 1, at a predetermined timing during the non-image formation, as described later, an operation such that the transfer residual toner deposited on the cleaning roller 32 is discharged from the cleaning roller 32 onto the photosensitive drum 4 is executed.

<Cleaning Mechanism>

Next, the cleaning mechanism 36 in the embodiment 1 will be described in detail. Parts (a) and (b) of FIG. 4 are schematic views for illustrating the action of the cleaning mechanism 36 in the embodiment 1. Part (a) of FIG. 4 shows a state of the photosensitive drum 4Y of the most upstream image forming portion PY for Y and a periphery thereof when the toner T is transferred onto the recording material S (during the image formation) and shows a state of the photosensitive drum 4M of the image forming portion PM for M disposed downstream of and adjacent to the most upstream image forming portion PY and a periphery thereof during the image formation. Part (b) of FIG. 4 shows a state of the photosensitive drum 4Y of the most upstream image forming portion PY for Y and a periphery thereof at a time other than during the transfer (i.e., during the non-image formation) and shows a state of the photosensitive drum 4M of the image forming portion PM for M disposed downstream of and adjacent to the most upstream image forming portion PY and a periphery thereof during the image formation. In the following, as regards the downstream-side image forming portions PM, PC and PK, principally, the image forming portion PM for M will be described, but in the embodiment 1, constitutions and operations of the downstream-side image forming portions PM, PC and PK are substantially the same except that colors of the toners used for development are different from each other. Incidentally, in FIG. 4, for simplification, suffixes Y and M of reference numerals or symbols representing elements for associated colors are appropriately omitted. As described above, the most upstream image forming portion PY is provided with the first cleaning mechanism 36*a* as the cleaning mechanism 36. Further, the downstream-side image forming portion PM is provided with the second cleaning mechanism 36*b* as the cleaning mechanism 36.

(Temporary Collection of Transfer Residual Toner)

With reference to part (a) of FIG. 4, an operation of the cleaning mechanism 36 when the toner image is transferred onto the recording material S (during the image formation) will be described.

First, behavior of transfer residual toner T1 will be described. In each of the most upstream image forming portion PY and the downstream-side image forming portion PM, the cleaning roller 32 is rotated in an arrow G direction (the counterclockwise direction) in the figure in contact with the photosensitive drum 4. That is, the cleaning roller 32 is rotated so that the photosensitive drum 4 and the cleaning roller 32 move in the same direction at a contact portion therebetween. In the embodiment 1, the cleaning roller 32 is rotationally driven by branch and transmission of a driving force from a driving motor (not shown) for driving the photosensitive drum 4. The cleaning roller 32 may be rotationally driven with a peripheral speed difference relative to the photosensitive drum 4 (for example, the cleaning roller 32 is faster in peripheral speed than the photosensitive drum 4) or may also be rotationally driven at the same peripheral speed as the peripheral speed of the photosensitive drum 4. Further, in the embodiment 1, the cleaning roller 32 is constituted by coating, around a roller shaft (axis) formed of metal or the like, a rubber layer formed of a rubber material as an elastic layer. As the rubber layer, for example, a solid rubber material or a sponge member which have elasticity is used. The surface of the photosensitive drum 4 contacting the cleaning roller 32 is lowered in surface potential to near 0 V by the discharging light source 31. Further, to the cleaning roller 32, a predetermined cleaning voltage (cleaning bias) is applied by the cleaning voltage source E4. In embodiment 1, the cleaning voltage source E4 applies, to the cleaning roller 32, a DC voltage of the negative polarity which is an opposite polarity to the normal polarity of the toner T, as the cleaning voltage. For that reason, the transfer residual toner T1 charged to the positive polarity is moved from the photosensitive drum 4 to the cleaning roller 32 along the electric field, and is collected on the cleaning roller 32. Incidentally, this cleaning voltage may only be required to be a voltage higher on an opposite side (the negative polarity side in the embodiment 1) to the normal polarity side of the toner than the surface potential of the photosensitive drum 4 at a contact portion between the cleaning roller 32 and the photosensitive drum 4.

In the most upstream image forming portion PY, the foreign matter collecting roller 33 is rotated in an arrow H direction (the clockwise direction) in the figure in contact with the cleaning roller 32. That is, the foreign matter collecting roller 33 is rotated so that the cleaning roller 32 and the foreign matter collecting roller 33 move in the same direction at a contact portion therebetween. In the embodiment 1, the foreign matter collecting roller 33 is rotationally driven by branch and transmission of a driving force from a driving motor (not shown) for driving the photosensitive drum 4. The foreign matter collecting roller 33 may be rotationally driven with a peripheral speed difference relative to the cleaning roller 32 (for example, the foreign matter collecting roller 33 is faster in peripheral speed than the cleaning roller 32) or may also be rotationally driven at the same peripheral speed as the peripheral speed of the cleaning roller 32. Further, in the embodiment 1, foreign matter collecting roller 33 is constituted by a metal roller. Incidentally, the foreign matter collecting roller 33 may also be constituted by a roller including an elastic layer similar to the elastic layer of the cleaning roller 32. To the foreign matter collecting roller 33, a predetermined voltage during toner collection (bias during toner collection) is applied by the collecting voltage source E5. In embodiment 1, the collecting voltage source E5 applies, to the foreign matter collecting roller 33, a DC voltage of the positive polarity which is the same polarity as the normal polarity of the toner T, as the voltage during toner collection. For that reason, the transfer residual toner T1 of the positive polarity collected on the cleaning roller 32 is not moved to the cleaning roller 32, and is held on the cleaning roller 32. Incidentally, this voltage during toner collection may only be required to be a voltage higher on the normal polarity side (the positive polarity side in the embodiment 1) than the surface potential of the cleaning roller 32 at a contact portion between the foreign matter collecting roller 33 and the cleaning roller 32.

Next, behavior of a foreign matter A such as fibers or filler of paper (so-called "paper powder") or dust will be described. The foreign matter A is large in amount in which the foreign matter A is moved to the photosensitive drum 4Y of the most upstream image forming portion PY and is small in amount in which the foreign matter A is moved to the photosensitive drum 4M of the downstream-side image forming portion PM. This is because most of the foreign matter A generated from the recording material S is removed at the transfer portion NY of the most upstream image forming portion PY. For that reason, in the embodiment 1, the foreign matter collecting roller 33, a scraping member 34, and a foreign matter collecting container 35 which are used for separating and collecting the foreign matter A are provided only in the first cleaning mechanism 36*a* of the most upstream image forming portion PY. Further, these members are not provided in the second cleaning mechanism 36*b* of the downstream-side image forming portion PM. By this, upsizing of entirety of the image forming apparatus 1 is suppressed.

In the most upstream image forming portion PY, during the transfer, to the transfer roller 16Y, the transfer voltage of the negative polarity, for example, the transfer voltage of about −1000 V is applied. Incidentally, this transfer voltage may only be required to be a voltage higher on the opposite polarity side (the negative polarity side in the embodiment 1) to the normal polarity side of the toner than the surface potential of the image portion of the photosensitive drum 4Y at the transfer portion NY. By this, the toner T charged to the positive polarity on the photosensitive drum 4Y is attracted onto the recording material S and is transferred onto the recording material S.

At this time, the foreign matter A existing on the recording material S and inside the recording material S is charged to the negative polarity by being subjected to electric discharge or injection charging of the negative polarity by the transfer voltage. Then, this foreign matter A is moved onto the photosensitive drum 4Y along the electric field by the transfer voltage. During the transfer, to the cleaning roller 32 contacting the photosensitive drum 4Y, a cleaning voltage on the negative polarity side relative to the surface potential of the photosensitive drum 4Y in a contact portion between the cleaning roller 32 and the photosensitive drum 4Y is applied. For that reason, the foreign matter A charged to the negative polarity is not collected on the cleaning roller 32.

In the most upstream image forming portion PY, after the transfer, the photosensitive drum 4Y is uniformly charged to the positive polarity by the charging device 5Y. Further, to the developing roller 6Y, a developing voltage on the negative polarity side relative to the surface potential (non-image portion potential) of the photosensitive drum 4Y in the contact portion between the developing roller 6Y and the photosensitive drum 4Y is applied. For that reason, the foreign matter A charged to the negative polarity is not collected also on the developing roller 6Y. Further, also to the transfer roller 16Y, the transfer voltage of the negative polarity is applied. For that reason, the foreign matter A charged to the negative polarity is not moved to also the recording material S and the transfer belt 12.

Accordingly, in setting of the applied voltage to each of the rollers during the transfer, at each of the image forming portions P, the transfer residual toner T1 is collected and held on the cleaning roller 32, and at the most upstream image forming portion PY, the foreign matter A is carried on the photosensitive drum 4Y. Behavior of the foreign matter A at the downstream-side image forming portion PM will be described later.

Incidentally, in the embodiment 1, at all the image forming portions P, settings of the transfer voltage, the developing voltage, and the collecting voltage during the image formation are the same.

(Collection of Transfer Residual Toner and Collection of Foreign Matter)

With reference to part (b) of FIG. 4, an operation of the cleaning mechanism 36 at the time other than during the transfer (i.e., at the time of non-image formation) will be described.

In each of the most upstream image forming portion PY and the downstream-side image forming portion PM, at a predetermined timing other than during the transfer, to the cleaning roller 32, a predetermined discharging voltage (discharging bias) is applied by the cleaning voltage source E4. In the embodiment 1, the cleaning voltage source E4 applies, as the discharging voltage, a DC voltage of the positive polarity which is the same polarity as the normal polarity of the toner T, to the cleaning roller 32. Incidentally, this discharging voltage may only be required to be a voltage higher on the normal polarity side (the positive polarity side in the embodiment 1) than the surface potential of the photosensitive drum 4 at the contact portion between the cleaning roller 32 and the photosensitive drum 4. Further, at this time, in the most upstream image forming portion PY, to the foreign matter collecting roller 33, predetermined voltage during foreign matter collection (bias during foreign matter collection) is applied by the collecting voltage source E5. In the embodiment 1, the collecting voltage source E5 applies, as the voltage during foreign matter collection, a DC voltage of the positive polarity larger in absolute value than the discharging voltage applied to the cleaning roller 32. Incidentally, this voltage during foreign matter collection may only be required to be a voltage higher on the normal polarity side (the positive polarity side in the embodiment 1) than the surface potential of the cleaning roller 32 at the contact portion between the foreign matter collecting roller 33 and the cleaning roller 32.

By the above-described potential setting, in each of the most upstream image forming portion PY and the downstream-side image forming portion PM, the transfer residual toner T1 charged to the positive polarity is discharged from the cleaning roller 32 onto the photosensitive drum 4. At this time, to the developing roller 6, the developing voltage on the negative polarity side relative to the surface potential (non-image portion potential) of the photosensitive drum 4 at the contact portion between the developing roller 6 and the photosensitive drum 4 is applied. For that reason, the transfer residual toner T1 discharged on the photosensitive drum 4 is collected on the developing roller 6 and is re-utilized as the toner T during subsequent image formation (during development). Further, by the above-described potential setting, in the most upstream image forming portion PY, the foreign matter A charged to the negative polarity on the photosensitive drum 4 is collected on the cleaning roller 32 and then on the foreign matter collecting roller 33.

To the foreign matter collecting roller 33, the scraping member 34 is contacted, and with rotation of the foreign matter collecting roller 33, the surface of the foreign matter collecting roller 33 is rubbed by the scraping member 34. As the scraping member 34, an elastic member such as a sponge or a felt is used. The scraping member 34 may also be a rubber blade or a plastic film which have elasticity. The foreign matter A collected on the foreign matter collecting roller 33 is scraped off of the foreign matter collecting roller 33 by the scraping member 34 and is collected in the foreign matter collecting container 35 by being dropped into the foreign matter collecting container 35. Behavior of the foreign matter A in the downstream-side image forming portion PM will be described later.

Incidentally, in the embodiment 1, with respect to all the image forming portions P, settings of the transfer voltage and the developing voltage are the same between when the transfer residual toner T1 is collected in the developing cartridge 8 during the image formation and during the non-image formation. Further, in the embodiment 1, at all the image forming portions P, settings of the discharging voltage are the same.

Further, the discharge of the transfer residual toner T1 from the cleaning roller 32 and the collection of the transfer residual toner T1 by the developing cartridge 8 can be executed at an arbitrary timing such as the sheet interval step without being limited to the post-rotation step if the timing is during the non-image formation.

(Behavior of Foreign Matter in Downstream-Side Image Forming Portion)

Most of the foreign matter A generating from the recording material S is removed at the transfer portion NY of the most upstream image forming portion PY. However, when the foreign matter A in a slight amount moves to the photosensitive drum 4M of the downstream-side image forming portion PM, the following behavior is exhibited. In the embodiment 1, the second cleaning mechanism 36*b* of the downstream-side image forming portion PM is not provided with the foreign matter collecting roller 33 for collecting the foreign matter A.

For that reason, in the downstream-side image forming portion PM, the foreign matter A is carried on the photosensitive drum 4 as shown in part (a) of FIG. 4 and is carried on the cleaning roller 32 as shown in part (b) of FIG. 4. As shown in parts (a) and (b) of FIG. 4, principles of movement of the foreign matter A onto the photosensitive drum 4 and the cleaning roller 32 in the downstream-side image forming portion PM are similar to the principles described for the above-described material image forming portion PY, respectively.

As described above, the amount of the foreign matter A generated from the recording material S and moved to the photosensitive drum 4 is remarkably large in the material image forming portion PY and is small in the downstream-side image forming portion PM. However, in recent years, the drum unit 30 and the developing cartridge 8 which are used as consumables, and the image forming apparatus 1 tend to be extended in lifetime. As a result, the foreign matter A is carried on the photosensitive drum 4 and on the cleaning roller 32 for a long term, and causes sticking in the latter half or the like of the lifetime of the unit, the cartridge or the apparatus, so that a lowering in function of the photosensitive drum 4 or the cleaning roller 32 occurs in some instances. For example, when the foreign matter A sticks to the photosensitive drum 4, a stripe-like image defect or a dot-like image defect occurs on the image in some instances. Further, when the foreign matter A sticks to the cleaning roller 32, a cleaning performance for the transfer residual toner T1 lowers, so than an image defect due to improper cleaning occurs in some instances. Further, when the foreign matter A carried on the photosensitive drum 4 is, for example, collected together with the transfer residual toner T1 in the developing cartridge 8 and an amount thereof exceeds a certain threshold, a charging property of the toner T and a regulating force of the regulating blade 60 change, so that an electric charge of the toner T is disordered and the image defect is caused in some instances.

Particularly, as in the embodiment 1, in a constitution in which the recording material S and the photosensitive drum 4 are directly in contact with each other, the amount of the foreign matter A generated from the recording material S and moved to the photosensitive drum 4 becomes large, so that the above-described problem is liable to occur. Further, as in the embodiment 1, in a constitution in which the transfer residual toner T1 is collected in the developing cartridge 8 and then is re-utilized as the toner T, the foreign matter A is liable to enter the developing cartridge 8, so that the above-described problem is liable to occur.

In order to solve the above-described problem due to the lifetime extension, it is important to reduce the amount of the foreign matter A moved to the photosensitive drum 4 of the downstream-side image forming portion by enhancing power of moving the foreign matter A to the photosensitive drum 4 of the upstream-side image forming portion P. In other words, it is important to reduce the amount of the foreign matter A sent to the downstream-side image forming portion P by enhancing power of removing the foreign matter A from the recording material S in the upstream image forming portion P. Further, in other words, it is important to reduce the amount of the foreign matter A stagnated in the downstream-side image forming portion PM provided with no foreign matter collecting roller 33 by enhancing power of collecting the foreign matter A in the most upstream image forming apparatus PY provided with the foreign matter collecting roller 33.

<Suppression of Movement of Foreign Matter Toward Downstream Side>

The foreign matter A generated from the recording material S is charged to the negative polarity by the voltage of the negative polarity applied to the transfer roller 16 in the most upstream image forming apparatus PY, and is moved onto the photosensitive drum 4Y. At this time, the amount of the foreign matter A moved to the photosensitive drum 4Y. i.e., the amount of the foreign matter A removed from the recording material S become larger with a larger potential difference between the transfer roller 16Y and the photosensitive drum 4Y. This is because with the larger potential difference between the transfer roller 16 and the photosensitive drum 4Y, the foreign matter A on or inside the recording material S is charged to the negative polarity stronger and is liable to be moved to the photosensitive drum 4Y.

Therefore, in the embodiment 1, the potential difference between the photosensitive drum 4Y and the transfer roller 16Y in the most upstream image forming portion PY is made larger than the potential difference between the photosensitive drum 4M and the transfer roller 16M in the downstream-side image forming portion PM. By this, the amount of the foreign matter A moved to the photosensitive drum 4Y in the most upstream image forming portion PY is made large, so that the amount of the foreign matter A moved to the photosensitive drum 4M in the downstream-side image forming portion PM can be reduced.

In general, as regards the image formed on the recording material S by the image forming apparatus 1, an area of the non-image portion is larger than an area of the image portion. Further, as regards the foreign matter A, in general, an amount thereof generated from a leading end and a trailing end, with respect to the feeding direction of the recording material S, corresponding to the non-image portions of the recording material S or from opposite end portions of the recording material S with respect to a widthwise direction (a direction substantially perpendicular to the feeding direction) is larger than an amount thereof generated from other portions. This is because the leading end, the trailing end, or the opposite end portions constitute cut surfaces when the recording materials S are manufactured, and therefore, the foreign matter generated during cutting exists in a large amount.

For that reason, in the most upstream image forming portion PY, it is important for improving power of moving the foreign matter A to the photosensitive drum 4Y of the most upstream image forming portion 4Y that a potential difference between the non-image portion of the photosensitive drum 4Y and the transfer roller 16Y is made large.

FIG. 5 is a graph showing a change in amount of the foreign matter A moved to the downstream-side photosensitive drum 4M of the downstream-side image forming portion PM in the case where a condition is changed in the following manner. In this case, a value obtained by subtracting the potential difference between the non-image portion of the photosensitive drum 4M and the transfer roller 16M in the downstream-side image forming portion PM from the potential difference between the non-image portion of the photosensitive drum 4Y and the transfer roller 16Y in the most upstream image forming portion PY is changed from −500 V to +1000 V. The recording material (paper) S used for printing is Xerox multipurpose paper (basis weight: 75 g/m$^2$, LTR size) manufactured by Xerox Corp. Further, a weight per 1000 sheets (printed) of the foreign matter A moved to the photosensitive drum 4M of the downstream-side image forming portion PM is plotted. The printed image is a lateral line image extending in the widthwise direction of the recording material S and with a print ratio of 4% for each color.

From FIG. 5, it turns out that the amount of the foreign matter A moved to the downstream-side photosensitive drum 4M is decreased with a larger value of a difference in potential difference obtained by subtracting the above-described latter potential difference from the above-described former potential difference.

In the embodiment 1, during the image formation (during the transfer), in the most upstream image forming portion PY and the downstream-side image forming portion PM, the same transfer voltage of −1000 V is applied to the transfer rollers 16Y and 16M, respectively. On the other hand, during the image formation (during the charging process), the surface potential (non-image portion potential) of the non-image portion of the photosensitive drum 4Y is +800 V in the most upstream image forming portion PY, and the surface potential (non-image portion potential) of the non-image portion of the photosensitive drum 4M is +500 V in the downstream-side image forming portion PM. That is, the charging voltage applied to the charging device 5 when the photosensitive drum 4 is charged is changed between the most upstream image forming portion PY and the downstream-side image forming portion PM.

By the above-described settings of the applied voltages, it is possible to increase the amount of the foreign matter A moved to the photosensitive drum 4Y of the most upstream image forming portion PY and to decrease the amount of the foreign matter A moved to the photosensitive drum 4M of the downstream-side image forming portion PY.

Further, in the embodiment 1, during the image formation (during the exposure), in the most upstream image forming portion PY and the downstream-side image forming portion PM, a light quantity of the laser light L of the exposure device 10 is adjusted so that the surface potentials (image portion potentials) of the image portions of the photosensitive drums 4Y and 4M become the same voltage of +100 V. Further, in the embodiment 1, during the image formation (during the development), in the most upstream image forming portion PY and the downstream-side image forming portion PM, the same developing voltage of +300 V is applied to the developing rollers 6Y and 6M, respectively. Thus, in the most upstream image forming portion PY and the downstream-side image forming portion PM, by uniformizing a potential difference between the image portion potential and the developing voltage (i.e., a developing contrast), a difference in density between the images formed in the image forming portions PY and PM is prevented from being made.

Potential settings during the image formation in the embodiment 1 is shown in the following table 1.

TABLE 1

| | Y (most upstream) | M (downstream side) |
|---|---|---|
| NIPP*1 | +800 V | +500 V |
| IPP *2 | +100 V | +100 V |
| DV*3 | +300 V | +300 V |
| TV*4 | −1000 V | −1000 V |

*1: "NIPP" is the non-image portion potential.
*2: "IPP" is the image portion potential.
*3: "DV" is the developing voltage.
*4: "TV" is the transfer voltage.

Incidentally, in the embodiment 1, settings of the charging voltages, the developing voltage, and the transfer voltage when the transfer residual toner T1 is collected in the developing cartridge 8 during the non-image formation in each of the image forming portions P are also the same as those shown above. However, these settings are not limited to the above-described settings, but for example, the setting of the charging voltage may also be changed between when the transfer residual toner T1 is collected in the developing cartridge 8 during the image formation and when the transfer residual toner T1 is collected in the developing cartridge 8 during the non-image formation. For example, the charging voltage when the transfer residual toner T1 is collected in the developing cartridge 8 during the non-image formation may also be made the same in all the image forming portions P.

Here, when a potential difference between the non-image portion potential and the developing voltage (i.e., a back contrast) becomes a certain threshold or less, collection of the transfer residual toner T1 in the developing cartridge 8 becomes difficult, so that there is a possibility that the difficulty has the influence on a subsequent image forming process and thus an image defect occurs. In the embodiment 1, in order to satisfactorily collect the transfer residual toner T1 in the developing cartridge 8 through a period of the lifetime of the developing cartridge 8, this potential difference was required to be 200 V or more. Further, on the other hand, the potential difference between the non-image portion potential and the developing voltage becomes the certain threshold or more, the toner T in a slight amount charged to the opposite polarity to the normal polarity of the toner T on the developing roller 6 is liable to move to the non-image portion on the photosensitive drum 4, so that there is a possibility that an image defect which is called a "fog" occurs. In the embodiment 1, when this potential difference exceeds 500 V, the fog occurred conspicuously. For that reason, in the embodiment 1, the non-image portion potential on the photosensitive drum 4Y of the most upstream image forming portion PY is set at +800 V, and the non-image portion potential on the photosensitive drum 4M of the downstream-side image forming portion PM is set at +500 V.

As described above, according to the embodiment 1, it is possible to enhance the power of moving the foreign matter A to the photosensitive drum PY of the most upstream image forming portion PY provided with the foreign matter collecting roller 33. By this, it is possible to reduce the amount of the foreign matter A moved to the photosensitive drum 4M of the downstream-side image forming portion PM provided with no foreign matter collecting roller 33. As a result, the image defect caused due to the foreign matter A with the lifetime extension of the drum unit 30, the developing cartridge 8, or the image forming apparatus 1 as described above can be suppressed.

Next, another embodiment of the present invention will be described. Basic constitution and operation of an image forming apparatus of an embodiment 2 are same as those of the image forming apparatus of the embodiment 1. Accordingly, in the image forming apparatus of the embodiment 2, elements having functions or constitutions which are the same as or corresponding to those of the image forming apparatus of the embodiment 1 are omitted from detailed description by adding the same reference numerals or symbols as those in the embodiment 1. Further, also in the embodiment 2, as regards the downstream-side image forming portions PM, PC and PK, the image forming portion PM for M will be principally described. However, in the embodiment 2, constitutions and operations of the downstream-side image forming portions PM, PC and PK are substantially the same except that colors of toners used for development are different from each other.

In the embodiment 2, by a means different from the means in the embodiment 1, the potential difference between the transfer roller 16Y and the non-image portion on the photosensitive drum 4Y in the most upstream image forming portion PY is made larger than the potential difference between the transfer roller 16M and the non-image portion on the photosensitive drum 4M in the downstream-side image forming portion PM.

In the embodiment 2, different transfer voltages are applied to the transfer roller 16Y of the most upstream image forming portion PY and the transfer roller 16M of the downstream-side image forming portion PM. Specifically, in the embodiment 2, the transfer voltage of −2000 V is applied to the transfer roller 16Y of the most upstream image forming portion PY, and the transfer voltage of −1000 V is applied to the transfer roller 16M of the downstream-side image forming portion PM.

By this, even when the non-image portion potential is not changed, the potential difference between the non-image portion on the most upstream photosensitive drum 4Y and the transfer roller 16 can be set so as to be larger than the potential difference between the non-image portion on the downstream-side photosensitive drum 4M and the transfer roller 16M. By this, the amount of the foreign matter A moved to the photosensitive drum 4Y of the most upstream image forming portion PY provided with the foreign matter collecting roller 33 can be increased, and the amount of the foreign matter A moved to the photosensitive drum 4M of the downstream-side image forming portion PM provided with no foreign matter collecting roller 33 can be decreased.

In the embodiment 2, the non-image portion potential on the photosensitive drum 4 does not have to be changed. For that reason, while suppressing possibilities of a lowering in collecting property of the transfer residual toner T1 and an occurrence of the fog, between the most upstream image forming portion PY and the downstream-side image forming portion PM, a large difference of 1000 V or more can be provided in terms of the potential difference between the non-image portion on the photosensitive drum 4 and the transfer roller 16. By this, the power of moving the foreign matter A to the photosensitive drum 4Y of the most upstream image forming portion PY can be further made large.

Potential settings during the image formation in the embodiment 2 is shown in the following table 2.

TABLE 2

| | Y (most upstream) | M (downstream side) |
|---|---|---|
| NIPP*1 | +500 V | +500 V |
| IPP *2 | +100 V | +100 V |
| DV*3 | +300 V | +300 V |
| TV*4 | −2000 V | −1000 V |

*1: "NIPP" is the non-image portion potential.
*2: "IPP" is the image portion potential.
*3: "DV" is the developing voltage.
*4: "TV" is the transfer voltage.

However, when the transfer voltage applied to the transfer roller 16Y of the most upstream image forming portion PY is made larger than the transfer voltage applied to the transfer roller 16M of the downstream-side image forming portion PM by 1000 V in terms of an absolute value as described above, the following other problem arises. That is, the potential difference between the image portion on the photosensitive drum 4Y and the transfer roller 16Y in the most upstream image forming portion PY becomes larger than the potential difference between the image portion on the photosensitive drum 4M and the transfer roller 16M in the downstream-side image forming portion PM. For that reason, a transfer property of the toner image on the photosensitive drum 4Y of the most upstream image forming portion PY changes relative to a transfer property of the toner image on the photosensitive drum 4M of the downstream-side image forming portion PM, so that the transfer residual toner T1 increases at the most upstream image forming portion PY.

Therefore, in the embodiment 2, the above-described problem of the change in transfer property between the most upstream image forming portion PY and the downstream-side image forming portion PM is solved by the following constitution. That is, in the embodiment 2, an electric resistance of the transfer roller 16Y of the most upstream image forming portion PY is made larger than an electric resistance of the transfer roller 16M of the downstream-side image forming portion PM. Specifically, in the embodiment 2, volume resistivity of a sponge material constituting the transfer roller 16Y of the most upstream image forming portion PY is made larger than volume resistivity of a sponge material constituting the transfer roller 16M of the downstream-side image forming portion PM.

When the electric resistance of the transfer roller 16 is large, in comparison with the case where the electric resistance is small, a value of a current flowing through the transfer roller 16 becomes small even when the potential difference between the transfer roller 16 and the photosensitive drum 4 is made large. For that reason, the potential difference between the transfer roller 16 and the photosensitive drum 4 for causing a transfer current necessary to transfer the toner image to flow through the transfer roller 16 becomes large. As a result, even when the potential difference between the transfer roller 16Y and the photosensitive drum 4Y in the most upstream image forming portion PY is larger than the potential difference between the transfer roller 16M and the photosensitive drum 4M in the downstream-side image forming portion PM, it is possible to obtain high values of the transfer efficiency similar to each other between the most upstream image forming portion PY and the downstream-side image forming portion PM.

FIG. 6 is a graph showing the transfer efficiency relative to the potential difference between the transfer roller 16 and the photosensitive drum 4 in the case where transfer rollers 16 with two kinds of electric resistances (volume resistivities of sponge materials) are used. The recording material (paper) S used for printing is the Xerox multipurpose paper (basis weight: 75 g/m$^2$, LTR size) manufactured by Xerox Corp. Further, the transfer efficiency is determined when a solid image with a highest (image) density is transferred as the image. Incidentally, the transfer efficiency is represented by a percentage [%] by calculating a ratio of a weight of the toner T transferred on the recording material S to a weight of the toner T on the photosensitive drum 4.

As shown in FIG. 6, a high-resistant transfer roller used as the transfer roller 16Y of the most upstream image forming portion PY shows higher transfer efficiency at a larger potential difference than a low-resistant transfer roller used as the transfer roller 16M of the downstream-side image forming portion PM.

In the embodiment 2, the volume resistivity of the sponge material constituting the transfer roller 16M of the downstream-side image forming portion PM is $1.0\times10^7$ [Ω·cm]. On the other hand, the volume resistivity of the sponge material constituting the transfer roller 16Y of the most upstream image forming portion PY is $1.0\times10^8$ [Ω·cm].

As described above, according to the embodiment 2, not only an effect similar to the effect of the embodiment 1 is obtained, but also it becomes possible to further enhance the power of moving the foreign matter A to the photosensitive drum 4Y of the most upstream image forming portion PY while suppressing possibilities of a lowering in collecting property of the transfer residual toner T1 and an occurrence of the fog.

Next, another embodiment of the present invention will be described. Basic constitution and operation of an image forming apparatus of an embodiment 3 are the same as those of the image forming apparatus of the embodiment 1. Accordingly, in the image forming apparatus of the embodiment 3, elements having functions or constitutions which are the same as or corresponding to those of the image forming apparatus of the embodiment 1 are omitted from detailed description by adding the same reference numerals or symbols as those in the embodiment 1. Further, also in the embodiment 3, as regards the downstream-side image forming portions PM, PC and PK, the image forming portion PM for M will be principally described. However, in the embodiment 2, constitutions and operations of the downstream-side image forming portions PM, PC and PK are substantially the same except that colors of toners used for development are different from each other.

In the embodiment 3, similarly as in the embodiment 2, different transfer voltages are applied to the transfer roller 16Y of the most upstream image forming portion PY and the transfer roller 16M of the downstream-side image forming portion PM (most upstream side: −2000 V, downstream side: −1000 V). For that reason, in the embodiment 3, similarly as in the embodiment 2, the potential difference between the image portion on the photosensitive drum 4Y and the transfer roller 16Y in the most upstream image forming portion PY becomes larger than the potential difference between the image portion on the photosensitive drum 4M and the transfer roller 16M in the downstream-side image forming portion PM. In the embodiment 3, the thus-caused problem of the change in transfer property between the most upstream image forming portion PY and the downstream-side image forming portion PM is solved by a means different from the means (constitution) in the embodiment 2.

In the embodiment 3, a kind of a material and a film thickness of a surface layer are different between the photosensitive drum 4Y of the most upstream image forming portion PY and the photosensitive drum 4M of the downstream-side image forming portion PM. In the embodiment 3, the film thickness of the surface layer of the photosensitive drum 4Y of the most upstream image forming portion PY is made smaller than the film thickness of the surface layer of the photosensitive drum 4M of the downstream-side image forming portion PM. Further, in the embodiment 2, an average molecular weight of a binder resin material constituting the surface layer of the photosensitive drum 4Y of the most upstream image forming portion PY is made larger than an average molecular weight of a binder resin material constituting the surface layer of the photosensitive drum 4M of the downstream-side image forming portion PM. Specifically, in the embodiment 3, the photosensitive drum 4Y of the most upstream image forming portion PY is 25 μm in film thickness (initial) of the surface layer and uses, as the binder resin material of the surface layer, a material of about 50,000 in average molecular weight. On the other hand, the photosensitive drum 4M of the downstream-side image forming portion PM is 30 μm in film thickness (initial) of the surface layer and uses, as the binder resin material of the surface layer, a material of about 20,000 in average molecular weight.

The toner T charged to the positive polarity on the photosensitive drum 4 is deposited on the photosensitive drum 4 by a mirror force between itself and the photosensitive drum 4. This mirror force becomes larger with a smaller film thickness of the surface layer, and in order to transfer the toner T, a larger potential difference (transfer contrast) between the photosensitive drum 4 and the transfer roller 16 is needed. That is, in order to ensure a high transfer property, there is a need to make the potential difference between the transfer roller 16 and the photosensitive drum 4 large.

In the embodiment 3, the film thickness of the surface layer of the photosensitive drum 4Y of the most upstream image forming portion PY is made smaller than the film thickness of the surface layer of the photosensitive drum 4M of the downstream-side image forming portion PM. By this, even when the potential difference between the transfer roller 16Y and the photosensitive drum 4Y in the most upstream image forming portion PY is larger than the potential difference between the transfer roller 16M and the photosensitive drum 4M in the downstream-side image forming portion PM, it is possible to obtain high transfer properties similar to each other between the most upstream image forming portion PY and the downstream-side image forming portion PM.

Here, when printing is continued by using the photosensitive drum 4, the surface layer of the photosensitive drum 4 is abraded little by little by rubbing with the recording material S, the cleaning roller 32, the developing roller 6, the toner T, and the like. Even in an abrasion amount when the printing of the images on the number of sheets corresponding to the lifetime of the photosensitive drum 4 is carried out, it is desired that the film thickness of the surface layer of the photosensitive drum 4 in an initial stage (at the time of a brand-new state) is determined so as to satisfy the functions of the photosensitive drum 4. In the embodiment 3, in the photosensitive drum 4 of the most upstream image forming portion PY, the film thickness of the surface layer is made small, and therefore, in order to satisfy the function through the lifetime period, it is desired that the abrasion amount of the surface layer is made small.

For that reason, in the embodiment 3, as the material of the surface layer of the photosensitive drum 4Y of the most upstream image forming portion PY, a material which is less abraded than the material of the surface layer of the photosensitive drum 4M of the downstream-side image forming portion PM is used. In the embodiment 3, in the most upstream image forming portion PY and the downstream-side image forming portion PM, as the photosensitive drum 4, a photosensitive member of a single layer type which is an organic photosensitive member of which charge polarity is the positive polarity is employed. That is, this photosensitive drum 4 is constituted by forming, around a cylindrical substrate formed of an electroconductive material such as metal, the surface layer of a single layer which is a photosensitive layer principally formed of a resin material. Further, in the embodiment 3, the photosensitive drum 4Y of the most upstream image forming portion PY uses, as the binder resin material of the surface layer thereof, a polycarbonate resin of about 50,000 in average molecular weight. On the other hand, the photosensitive drum 4M of the downstream-side image forming portion PM uses, as the binder resin material of the surface layer thereof, a polycarbonate resin of about 20,000 in average molecular weight.

Thus, in the embodiment 3, the photosensitive drum 4Y of the most upstream image forming portion PY uses, as the binder resin material, a resin material larger in average molecular weight and harder than a resin material of the photosensitive drum 4M of the downstream-side image forming portion PM. By this, in the embodiment 3, the surface layer of the photosensitive drum 4Y of the most upstream image forming portion PY is less abraded than the surface layer of the photosensitive drum 4M of the photosensitive drum 4M of the downstream-side image forming portion PM. Specifically, in the embodiment 3, the abrasion amount of the surface layer of the photosensitive drum 4Y of the most upstream image forming portion PY per 1000 sheets printed is 0.2 μm on average. On the other hand, the abrasion amount of the surface layer of the photosensitive drum 4M of the downstream-side image forming portion PM per 1000 sheets printed is 0.4 μm on average. The recording material (paper) S used for printing is the Xerox multipurpose paper (basis weight: 75 g/m$^2$, LTR size) manufactured by Xerox Corp.

In the embodiment 3, the lifetime of the photosensitive drum 4 is about 25.000 sheets in terms of the number of sheets printed. The surface layer of the photosensitive drum 4Y of the most upstream image forming portion PY is abraded by about 5 μm from an initial film thickness in the last stage of the lifetime thereof.

On the other hand, the surface layer of the photosensitive drum 4M of the downstream-side image forming portion drum is abraded by about 10 μm from an initial film thickness in the last stage of the lifetime thereof. As described above, in the embodiment 3, the initial film thickness of the surface layer of the photosensitive drum 4 is 25 μm for the photosensitive drum 4Y of the most upstream image forming portion 4Y and is 30 μm for the photosensitive drum 4M of the downstream-side image forming portion PM. For that reason, the film thickness of the surface layer remaining in the last stage of the lifetime is about 20 μm for the photosensitive drum 4 of each of the most upstream image forming portion PY and the downstream-side image forming portion PM, and thus is substantially the same.

Incidentally, for example, in the case where as a material of the surface layer of the photosensitive drum 4, a material which is not abraded sufficiently is used or in the like case, of the kind and the film thickness of the material of the surface layer of the photosensitive drum 4, only the film thickness may also be made different between the most upstream image forming portion PY and the downstream-side image forming portion PM.

As described above, according to the embodiment 3, not only an effect similar to the effect of the embodiment 1 can be obtained, but also it becomes possible to further enhance the power of moving the foreign matter A to the photosensitive drum 4Y of the most upstream image forming portion PY, similarly as in the embodiment 2.

Next, another embodiment of the present invention will be described. Basic constitution and operation of an image forming apparatus of an embodiment 4 are the same as those of the image forming apparatus of the embodiment 1. Accordingly, in the image forming apparatus of the embodiment 4, elements having functions or constitutions which are the same as or corresponding to those of the image forming apparatus of the embodiment 1 are omitted from detailed description by adding the same reference numerals or symbols as those in the embodiment 1. Further, also in the embodiment 4, as regards the downstream-side image forming portions PM, PC and PK, the image forming portion PM for M will be principally described. However, in the embodiment 4, constitutions and operations of the downstream-side image forming portions PM, PC and PK are substantially the same except that colors of toners used for development are different from each other.

In the embodiment 4, similarly as in the embodiment 2, different transfer voltages are applied to the transfer roller 16Y of the most upstream image forming portion PY and the transfer roller 16M of the downstream-side image forming portion PM (most upstream side: −2000 V, downstream side: −1000 V). For that reason, in the embodiment 4, similarly as in the embodiment 2, the potential difference between the image portion on the photosensitive drum 4Y and the transfer roller 16Y in the most upstream image forming portion PY becomes larger than the potential difference between the image portion of the photosensitive drum 4M and the transfer roller 16M in the downstream-side image forming portion YM. In the embodiment 4, a problem of a change in transfer property caused by this between the most upstream image forming portion PY and the downstream-side image forming portion PM is solved by a means different from the means in the embodiments 2 and 3.

In the embodiment 4, an electric charge amount of the toner T supplied to the photosensitive drum 4Y of the most upstream image forming portion PY is made larger than an electric charge amount of the toner T supplied to the photosensitive drum 4M of the downstream-side image forming portion PM. Here, the electric charge amount of the toner T refers to an electric charge amount per unit area of the toner T on the photosensitive drum 4 on which a solid image is formed. That is, the electric charge amount of the toner T is a total electric charge amount per unit area of the toner T for forming the solid image on the photosensitive drum 4. In the embodiment 4, the electric charge amount per unit area of the toner T for forming the solid image is 230 μC/m$^2$ on the photosensitive drum 4Y of the most upstream image forming portion PY and is 150 μC/m$^2$ on the photosensitive drum 4M of the downstream-side image forming portion PM.

FIG. 7 is a graph showing the transfer efficiency relative to the potential difference between the transfer roller 16 and the photosensitive drum 4 in the case where two kinds of toners T are used. The recording material (paper) S used for printing is the Xerox multipurpose paper (basis weight: 75 g/m$^2$, LTR size) manufactured by Xerox Corp. Further, the transfer efficiency is determined when a solid image with a highest (image) density is transferred as the image. Further, the transfer efficiency is represented by a percentage [%] by calculating a ratio of a weight of the toner T transferred on the recording material S to a weight of the toner T on the photosensitive drum 4.

As shown in FIG. 7, in order to transfer, at higher transfer efficiency, the toner T with a larger electric charge amount from the photosensitive drum 4 onto the recording material S, there is a need to make the potential difference between the photosensitive drum 4 and the transfer roller 16 larger. In the embodiment 4, in the most upstream image forming portion PY in which the toner T with the larger electric charge amount is used, the following constitution is employed for obtaining a high transfer property similarly as in the downstream-side image forming portion PM. That is, the potential difference between the photosensitive drum 4Y and the transfer roller 16Y of the most upstream image forming portion PY is set so as to be made larger than the potential difference between the photosensitive drum 4M and the transfer roller 16M of the downstream-side image forming portion PM. As a result, the power of moving the foreign matter A to the photosensitive drum 4Y of the most upstream image forming portion PY is improved, so that it is possible to reduce the amount of the foreign matter A moved to the photosensitive drum 4M of the downstream-side image forming portion PM.

Here, in order to enhance the electric charge amount of the toner T supplied to the photosensitive drum 4Y in the most upstream image forming portion PY without transferring, into the recording material S, the toner in a large amount wastefully, in the embodiment 4, the following constitution is employed. That is, an average particle size of the toner T supplied to the photosensitive drum 4Y in the most upstream image forming portion PY is made larger than an average particle size of the toner T supplied to the photosensitive drum 4M in the downstream-side image forming portion PM by 1 μm. When the average particle size of the toner T is large, an electric charge amount per (one) particle of the toner T becomes large, and therefore, a total electric charge amount of the toner T on the photosensitive drum 4 becomes large.

Incidentally, a means for increasing the electric charge amount of the toner T supplied to the photosensitive drum 4 is not limited to the means employed in the embodiment 4. For example, an external additive to the toner T may also be changed to an external additive when a high charging property is desired. Further, for example, the materials of the regulating blade 60 and the surface layer of the developing roller 6 may also be charged to materials high in chargeability to the toner T. Further, for example, to the regulating blade 60, by applying a voltage larger on the normal polarity side (the positive polarity side in the embodiment 4) than the potential of the developing roller 6, the chargeability to the toner T may also be improved.

As described above, according to the embodiment 4, not only an effect similar to the effect of the embodiment 1 can be obtained, but also it becomes possible to further enhance the power of moving the foreign matter A to the photosensitive drum 4Y of the most upstream image forming portion PY, similarly as in the embodiment 2.

In the above, the present invention was described in accordance with the specific embodiments, but the present invention is not limited to the above-described embodiments.

In the above-described embodiments, the foreign matter collecting member was provided only in the most upstream image forming portion, but may also be provided in the downstream-side image forming portion. As described above, the problem resulting from the foreign matter moved to the downstream-side image bearing member due to the extension of the lifetime of the unit including the image bearing member and/or the developing device, or the image forming apparatus is conspicuous in the constitution in which the foreign matter collecting member is provided only in the most upstream image forming portion. However, also, in the case where the foreign matter collecting member is provided in the downstream-side image forming portion, inconveniences due to sticking of the foreign matter, sent to the downstream-side image forming portion, to the image bearing member and the cleaning member and due to collection of the foreign matter into the developing device can occur. Accordingly, also, in the constitution in which the foreign matter collecting member is provided in the downstream-side image forming portion, by applying the present invention thereto, it is possible to obtain an effect similar to the effects of the above-described embodiments.

Further, in the above-described embodiments, as regards each of the charging voltage and the developing voltage, only the DC voltage component was described, but each of the charging voltage and the developing voltage may also be an oscillating voltage in which the DC voltage (DC component) and an AC voltage (AC component) are superposed with each other. This is also true for the collecting voltage and the discharging voltage.

Further, in the above-described embodiments, the discharging light source as the discharging means was used, but for example, in the case where a charging means with sufficiently less charging non-uniformity is used or in the like case, the discharging means does not have to be provided.

Further, in the above-described embodiments, the one-component non-magnetic contact developing method was employed, but the present invention is not limited thereto, and a two-component non-magnetic contact developing method, a non-contact developing method, a magnetic developing method, or the like may also be employed.

In the above-described embodiments, the cleaning member was the rotatable roller-shaped member, but for example, may also be a rotatable brush-shaped member (brush roller). Further, in the above-described embodiments, the foreign matter collecting member was the rotatable roller-shaped member, but for example, may also be a rotatable brush-shaped member (brush roller).

Further, in the above-described embodiments, the image bearing member was the rotatable drum-shaped member, but for example, may also be an endless belt. Further, in the above-described embodiments, the transfer member was the rotatable roller-shaped member, but the present invention is not limited thereto. For example, the transfer member may also be a pad-like member, a sheet-like member, a brush-like member (a fixed brush, a rotatable brush roller, or the like), a rotatable endless belt (which may also be provided with an urging member contacting the photosensitive member via the belt), or the like. Further, the charging member may also be a rotatable roller-shaped member, a brush-shaped member (rotatable brush roller or the like), a rotatable endless belt, or the like.

Further, in the above-described embodiments, the image forming apparatus includes the four image forming portions, but the number of the image forming portions may only be required to be two or more depending on the number of colors used, and for example, may also be three, or five or more.

According to the present invention, the amount of the foreign matter moved to the downstream-side image bearing member is reduced by enhancing the power of moving the foreign matter to the upstream-side image bearing member, whereby it is possible to suppress the image defect resulting from the foreign matter with the extension of the lifetime of the image bearing member or the unit including the developing device.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-218059 filed on Dec. 25, 2020, which is hereby incorporated by reference herein in its entirety.

What is claimed is:

1. An image forming apparatus capable of executing an image forming operation for forming an image on a recording material, said image forming apparatus comprising:

a first image forming portion including a rotatable first image bearing member having a surface layer formed on a surface thereof, a first charging member for electrically charging the surface of said first image bearing member, a first developing member for supplying a first developer to the surface of said first image bearing member, a first transfer member for transferring the first developer, supplied to the surface of said first image bearing member, onto a recording material, a first cleaning member in contact with said first image bearing member for cleaning the surface of said first image bearing member, and a foreign matter collecting member in contact with said first cleaning member for collecting foreign matter deposited on said first cleaning member;

a second image forming portion including a rotatable second image bearing member having a surface layer formed on a surface thereof, a second charging member for electrically charging the surface of said second image bearing member, a second developing member for supplying a second developer to the surface of said second image bearing member, a second transfer member for transferring the second developer, supplied to the surface of said second image bearing member, onto a recording material, and a second cleaning member in contact with said second image bearing member for cleaning the surface of said second image bearing member;

a belt configured to form a first transfer portion in contact with said first image bearing member and to form a second transfer portion in contact with said second image bearing member, said belt nipping and feeding the recording material between said belt and said first image bearing member at the first transfer portion and between said belt and said second image bearing member at the second transfer portion;

a charging voltage applying portion configured to apply a first charging voltage to said first charging member and to apply a second charging voltage to said second charging member;

a cleaning voltage applying portion configured to apply a first cleaning voltage to said first cleaning member and to apply a second cleaning voltage to said second cleaning member, and a transfer voltage applying portion configured to apply a first transfer voltage to said first transfer member and to apply a second transfer voltage to said second transfer member, wherein with respect to a movement direction of the recording material, said first image forming portion is provided upstream of said second image forming portion, wherein in the image forming operation, an absolute value of the first transfer voltage is greater than an absolute value of the second transfer voltage, wherein the polarity of the first transfer voltage and the polarity of the first cleaning voltage are of opposite polarity to the normal polarity of the first developer, the polarity of the second transfer voltage and the polarity of the second cleaning voltage are of opposite polarity to the normal polarity of the second developer, and wherein a first layer thickness of the surface layer of the first image bearing member is thinner than a second layer thickness of the surface layer of the second image bearing member.

2. The image forming apparatus according to claim 1, wherein said second image forming portion is not provided with a foreign matter collecting member.

3. The image forming apparatus according to claim 1, wherein in the image forming operation, a difference at the first transfer portion between a potential at which the image to be formed on said first image bearing member is formed and the potential at which the image is not formed is greater than a difference at the second portion between a potential at which the image to be formed on said second image bearing member is formed and the potential at which the image is not formed.

4. The image forming apparatus according to claim 1, wherein in the image forming operation, a potential difference at the first transfer portion between a potential at which the image to be formed on said first image bearing member is formed and the first transfer voltage is greater than a potential difference at the second transfer portion between a potential at which the image to be formed on said second image bearing member is formed and the second transfer voltage.

5. The image forming apparatus according to claim 4, wherein each of said first transfer member and said second transfer member comprises a roller including an elastic layer formed around a shaft, and wherein a volume resistivity of a material of said elastic layer constituting said first transfer member is greater than volume resistivity of a material of said elastic layer constituting said second transfer member.

6. The image forming apparatus according to claim 4, wherein a total electric charge amount per unit area of the first developer for forming a solid image on said first image bearing member is greater than a total electric charge amount per unit area of the second developer for forming a solid image on said second image bearing member.

7. The image forming apparatus according to claim 1, wherein an average molecular weight of a binder resin material constituting the surface layer of said first image bearing member is greater than an average molecular weight of a binder resin material constituting the surface layer of said second image bearing member.

8. The image forming apparatus according to claim 1, wherein an average particle size of the first developer is larger than an average particle size of the second developer.

9. The image forming apparatus according to claim 1, wherein the first charging voltage is greater than the second charging voltage.

10. The image forming apparatus according to claim 1, further comprising:

a collecting voltage applying portion configured to apply a collecting voltage to said foreign matter collecting member, wherein the polarity of the collecting voltage is the same as the normal polarity of the first developer.

* * * * *